US007670233B2

(12) United States Patent
Jones

(10) Patent No.: US 7,670,233 B2
(45) **Date of Patent: *Mar. 2, 2010**

(54) GOLF SWING TRAINING DEVICE METHOD AND APPARATUS

(76) Inventor: Jack Jones, 12521 Hilltop Rd., Arlington, WA (US) 98223

(*) Notice: Subject to any disclaimer, the term of this patent is extended or adjusted under 35 U.S.C. 154(b) by 345 days.

This patent is subject to a terminal disclaimer.

(21) Appl. No.: 11/533,721

(22) Filed: Sep. 20, 2006

(65) Prior Publication Data

US 2008/0070712 A1 Mar. 20, 2008

(51) Int. Cl.
*A63B 69/36* (2006.01)

(52) U.S. Cl. ..... 473/257; 473/226; 473/229

(58) Field of Classification Search ..... 473/226, 473/229, 257, 258, 259, 261
See application file for complete search history.

(56) References Cited

U.S. PATENT DOCUMENTS

| | | | | |
|---|---|---|---|---|
| 1,399,761 | A | 12/1921 | Garland | |
| 1,567,530 | A | 12/1925 | Macnaughton et al. | |
| 1,633,527 | A * | 6/1927 | Hansen | 473/229 |
| 1,634,102 | A * | 6/1927 | Hansen | 473/229 |
| 1,670,409 | A * | 5/1928 | Hansen | 473/229 |
| 1,854,392 | A | 5/1932 | Bambrick | |
| 1,960,787 | A * | 5/1934 | Macstocker | 473/229 |
| 2,520,287 | A | 8/1950 | Plunkett et al | |
| 2,653,025 | A | 9/1953 | Zega | |
| 3,339,927 | A | 9/1967 | Nunn | |
| 3,489,416 | A | 1/1970 | Mark | |
| 3,711,103 | A * | 1/1973 | Seltzer | 473/229 |
| 3,730,531 | A * | 5/1973 | Zega | 473/259 |
| 3,794,329 | A | 2/1974 | Wilson | |
| 3,795,399 | A * | 3/1974 | Beckish | 473/229 |
| 3,953,035 | A * | 4/1976 | Beckisk | 473/229 |
| 4,071,251 | A * | 1/1978 | Beckish | 473/259 |
| 4,852,881 | A * | 8/1989 | Bellagamba et al. | 473/216 |
| 5,069,456 | A | 12/1991 | Bellagamba | |
| 5,439,225 | A | 8/1995 | Gvoich et al. | |
| 5,467,993 | A * | 11/1995 | Higginson | 473/229 |
| 5,895,327 | A | 4/1999 | Francisco | |
| 5,984,798 | A | 11/1999 | Gilmour | |
| 6,165,079 | A | 12/2000 | Czaja | |
| 6,273,826 | B1 | 8/2001 | Bauer | |
| 6,364,786 | B1 | 4/2002 | Khano | |
| 6,582,319 | B2 | 6/2003 | Czaja | |
| 7,074,133 | B1 * | 7/2006 | Jones et al. | 473/257 |

* cited by examiner

*Primary Examiner*—Nini Legesse
(74) *Attorney, Agent, or Firm*—Michael F. Hughes; Hughes Law Firm, PLLC

(57) ABSTRACT

A golf swing training aid adapted to have a first rail and a second rail whereby a carriage system is slidably attached thereto and the pitch of the club is controlled with respect to the position of the carriage assembly in the course of a swing. In one form, the rotation of the club about the shaft (the roll) is controlled in conjunction with the pitch of the club.

21 Claims, 26 Drawing Sheets

GOLF SWING TRAINING DEVICE METHOD AND APPARATUS

RELATED APPLICATIONS

This application claims priority benefit of U.S. Ser. No. 11/155,710, filed Jun. 17, 2005, which is a divisional of U.S. Ser. No. 10/891,935, filed Jul. 14, 2004, now U.S. Pat. No. 7,074,133 B1.

BACKGROUND OF THE INVENTION

The invention relates to a golf training aid, specifically a golf aid that provides one degree of freedom whereby the swing plane and pitch of the club is well defined.

The prior art has numerous golf training type instruction and exercising machines that are adapted to train a golf student; however, the prior art is primarily geared towards providing golf swing training apparati that control the path of the swing at a certain portion of the club; in other words, many of the prior art devices are adapted to have some form of a track where a golf club, or representation of a golf club is attached thereto and the club moves along such a track. The numerous prior art references disclose a variety of mechanisms to provide such a track for a swing, however, the prior art has failed to restrict the degrees of freedom of a golf swing properly so a student of golf, particularly a newer student can get the feel of a proper golf swing. For example, the swing plane of a golf swing is critical to having a proper contact on a ball. Further the pitch of the golf club is an element of a golf swing that is desirable to train with a golf student. Further, in one form, the roll of the club (the rotation about the shaft of the club) can be controlled where the golf training apparatus as described herein allows for one degree of freedom of motion. Of course in other forms additional degrees of freedom are provided depending upon the goals and desires of the golf student.

When a golf student is trained by an instructor, oftentimes instructor would like to observe the bio-kinematic movements of the golf student in the course of a swing. For example, it is normally desirable to have the head of the golf student relatively stationary in the course of a swing and employ the hips to obtain the maximum power and accuracy. Further, various instructors would like to observe the wrist and bending of the arms in the course of a swing. Also, the follow-through of the swing as well as other elements such as foot placement knee bend and any desirable or potentially undesirable movements must be observed by the golf trainer. Therefore, it is advantageous to provide a golf training apparatus that provides a consistent swing where the movement of the golf club like handle (which can be the portion of an actual golf club in one form) is restricted and the trainer can focus upon the bio-kinematic movements of the golf student.

In one form, the golf club like handle as one degree of freedom whereby the swing plane, pitch and roll of the club is controlled. In engineering vernacular, one degree of freedom is defined as one possible orientation of the golf club like handle at a particular position along the golf swing. In general, the golf swing is defined at various positions corresponding to the numerals of a clock. Of course the numerals do not line up exactly to the various positions but generally speaking a six o'clock position is the approximate location of a golf club to impact the golf ball at the bottom dead center location. Of course various golf pro trainers and theories teach different locations of impact for the club head to the golf ball and further teach different areas of placement of the golf ball with respect to the stance of the golf student to adjust such impact. But generally speaking the bottom dead center approximate location of the golf club is the position of the golf swing where impact upon the golf ball occurs. A nine o'clock position is the rearward backstroke position and the three o'clock position is the follow-through portion of stroke. Therefore, in one form where the golf training apparatus has employed one degree of freedom for the golf swing, at any position along the golf swing, the club has only one orientation and space. This restriction gives a golf trainer confidence that his or her student has the correct positioning of the golf club like handle and the trainer can focus upon the golf student's bio-kinematic movements.

Of course in other forms, the roll of the club can be an additional degree of freedom. Further, there are various types of linkages that can control the roll or give partial control of the roll such as using a cam system as shown in a second embodiment.

Therefore, it can be appreciated that a golf training apparatus that not only controls the swing plane of the golf club, but further controls the pitch of the golf club and in one form has a mechanism to convert the rearward pitch to a forward pitch at the approximate six o'clock position. Further, the system provides for controlling the swing plane of the golf club like handle which in one form can remain in a planar region or alternatively in a curved plane region whereby the first and second rails are not in a single plane but extended therefrom the plane as desired to train for a proper swing.

Further, it is found to be desirable to have an adjustable system in one form of the apparatus that adjusts the height and angle of the rail system that defines the path of the carriage assembly which is connected to the golf club like handle.

In addition to having training benefits of a trainers perspective where the trainer can observe the bio kinetic movements of the golf student and have confidence that the path of the club is proper, the student gains muscle memory of a proper swing. In other words the trainer can focus on the movements of the golf student such as hip movement and head location.

Further, because many of the degrees of freedom of the golf club is controlled (only having one degree of freedom of movement in one embodiment), the flight of the ball is consistent and thus enhances the students confidence of the golf swing techniques that are not always intuitive to a beginning student.

SUMMARY OF THE INVENTION

In one form the golf swing training aid is adapted to train a golf student with a golf swing of the golf student where a golf swing of the student has rearward and forward swing directions and having various swing positions, the golf swing apparatus comprises a frame arranged to support a first rail and a second rail the first and second rails defining a swing plane. A carriage assembly is provided having a first attachment region and a second attachment region where the first attachment region is arranged to be slidably attached to the first rail and the second attachment region is arranged to be slidably attached to the second rail. The first and second attachment regions are positioned a fixed distance from one another on the carriage. The carriage further having a golf club like handle having an upper connection portion pivotally attached to the first attachment region of the carriage and a lower connection portion pivotally connected to the second attachment region. The carriage is arranged to reposition in a rearward swing direction and a forward swing direction whereby the distance between the first rail and the second rail in the swing plane fluctuates with respect to the location of the carriage at various swing positions whereby said distance between the first and second rail at various swing positions dictates the pitch of the carriage assembly and a golf club like handle providing the golf student with a desired golf swing.

DETAILED DESCRIPTION OF THE PREFERRED EMBODIMENTS

In general, it is desirable to train a student of golf to have the proper swing plane, pitch of club as well as the roll of the club about the longitudinal shaft.

Figure 1:
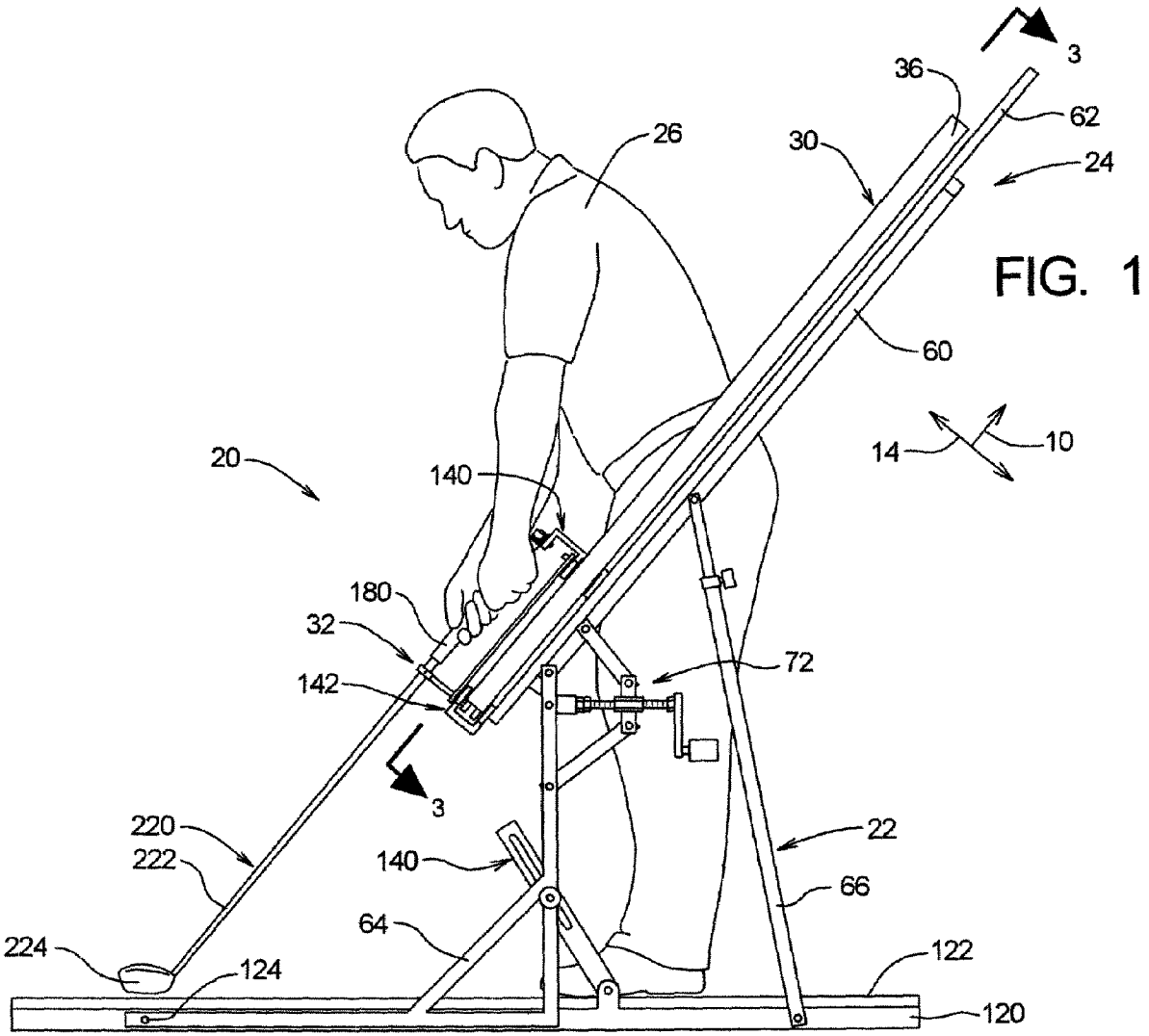
FIG. 1 shows a side view of the golf training aid where golf student is positioned in the central open area and grasping the golf clublike handle.
Figure 2:
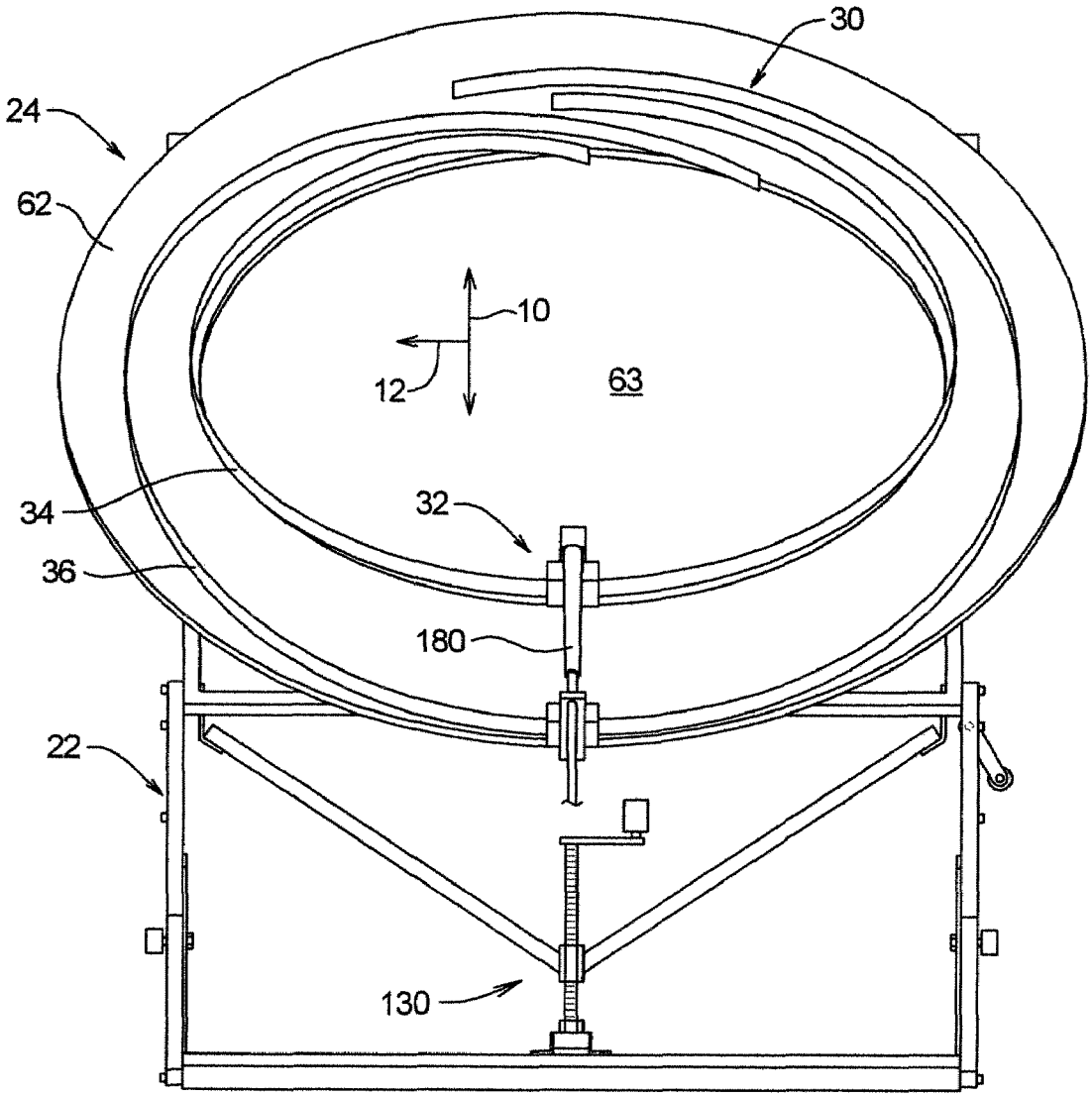
FIG. 2 is a front view of the golf training aid.

As shown in FIG. 1, an axis system is defined whereby the arrow 10 indicates a transverse direction. As shown in FIG. 2, the axis 12 indicates a lateral direction and the arrow indicated at 14 in FIG. 1 indicates a forward-rearward axis.

As shown in FIG. 1, the golf swing training aid/apparatus 20 comprises a base frame 22 and an active area 24. In general, the base frame 22 is adapted to support the active area. The base frame in one form comprises an adjustment systems to position the active area in a proper orientation for the golf student 26 as shown in FIG. 1. The active area generally comprises the rail system 30 and carriage assembly 32 that are described in detail below.

Figure 3:
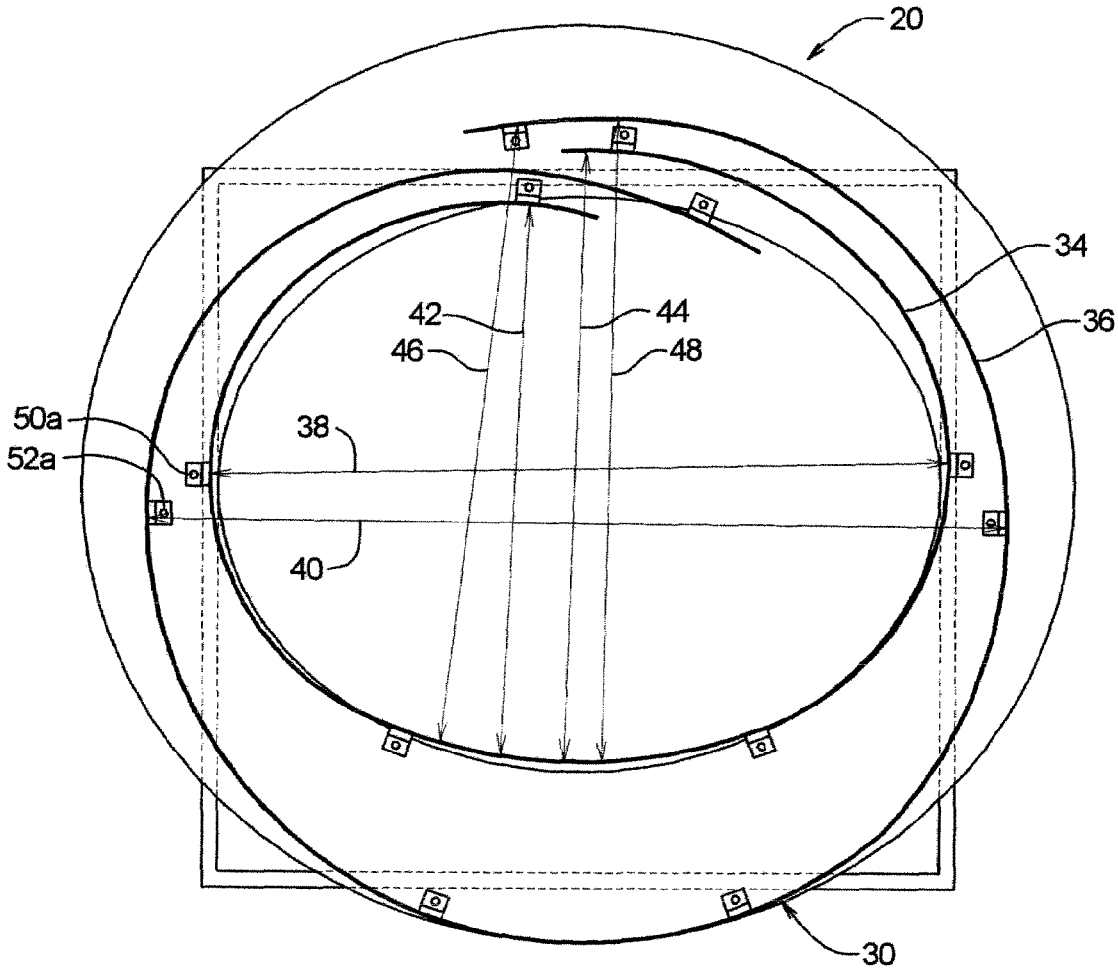
FIG. 3 is an orthogonal view of the adjustment disk and rail system of the golf training aid.

As shown in FIG. 2, the active area 24 comprises a rail system 30 and a carriage assembly 32. The rail system 30 comprises a first rail 34 and a second rail 36. FIG. 3 shows a front view along the rearward access upon the first and second rails 34 and 36. In general, the dimension of the rail system is slightly oval whereby the lateral dimensions 38 and 40 for the first and second rails 34 and 36. Of course these are general indicators and illustrate a relationship between the width in the lateral direction and the height in the transverse direction for the rail system to accommodate various students of golf that would use the golf swing training aid 20 to appreciate the fundamentals of a proper golf swing. In one form, the first and second rails 34 and 36 are comprised of a flexible strip of material such as a metallic material which has a thickness in the rearward direction as shown in FIG. 1 to provide a certain amount of stability and the rails are further relatively thin as shown in FIG. 3 so they can be flexed in an oval like pattern as shown in this figure. A plurality of fasteners generally indicated by the numerals 50 and 52 (whereby specific fasteners are indicated by a subset lettering system such as 50A and 50B etc.). A few of the fasteners can have adjustment features as discussed further herein.

As will be described further below regarding the method of training a golf student, the first and second rails 34 and 36 are strategically positioned from one another substantially in the forward-rearward plane which is defined as the substantially orthogonal plane to the forward-rearward axis 14 that is shown in FIG. 1. FIG. 3 is a front view of the forward-rearward plane whereby this plane is essentially defined by the rail system 30 which is comprised of the first and second rails 34 and 36. In one form, the rails 34 and 36 lie directly on a flat plane in a similar manner as shown in FIG. 1. However, in some forms it may be desirable to train a student where the golf swing is not in a flat plane but rather the first or second rails 34 and 36 would reposition in the forward or rearward direction 14 (see FIG. 1 where the adjustment system 72 provides for some adjustment). Therefore, the plane defined by the rails 34 and 36 is referred to as the swing plane and as described below the carriage assembly 32 travels in this plane at various points of rotation along the swing of the golf student.

Figure 4:
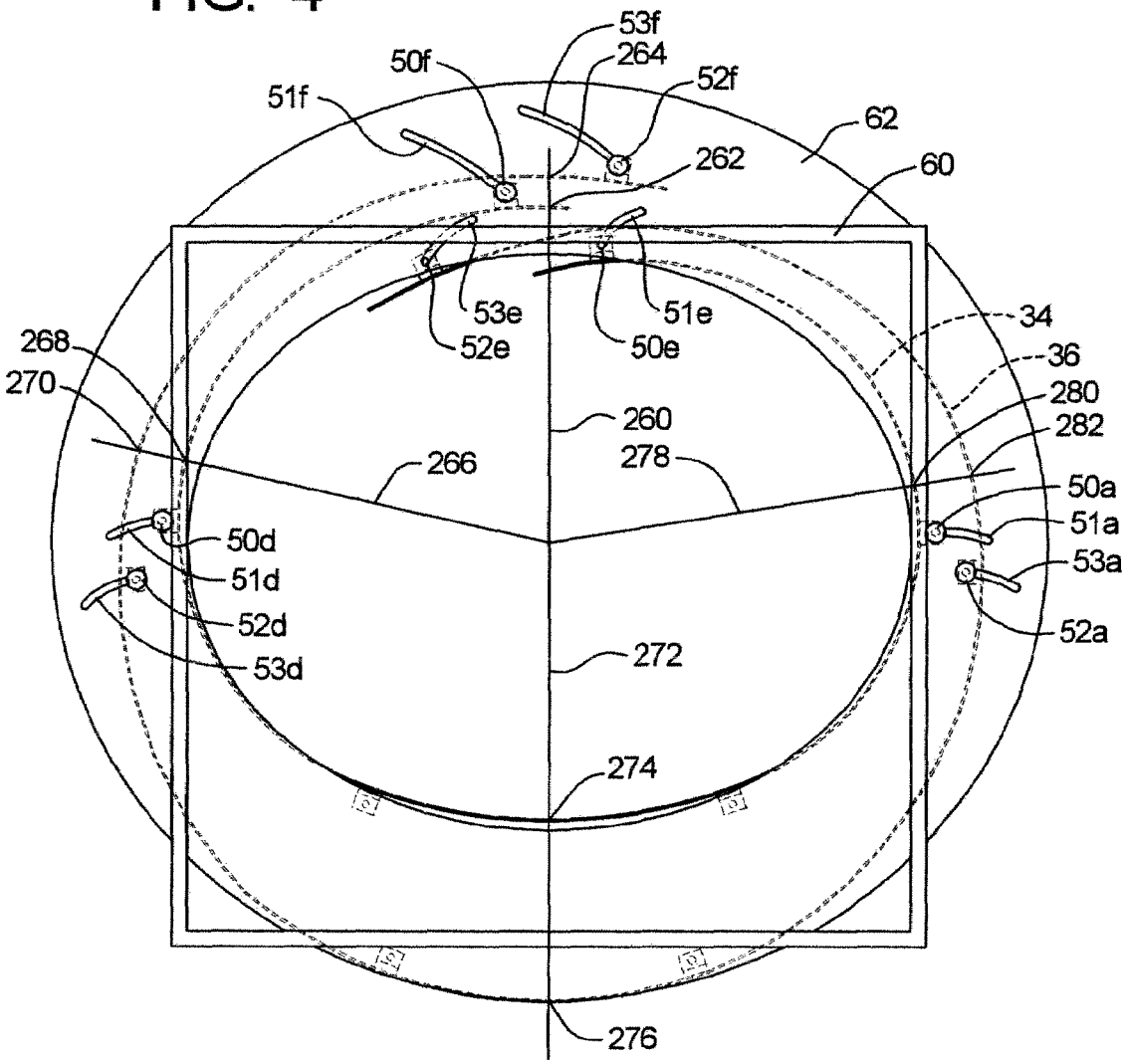
FIG. 4 is a rearview of the base adjustment disk and the adjustment system of the first and second rail.
Figure 16:
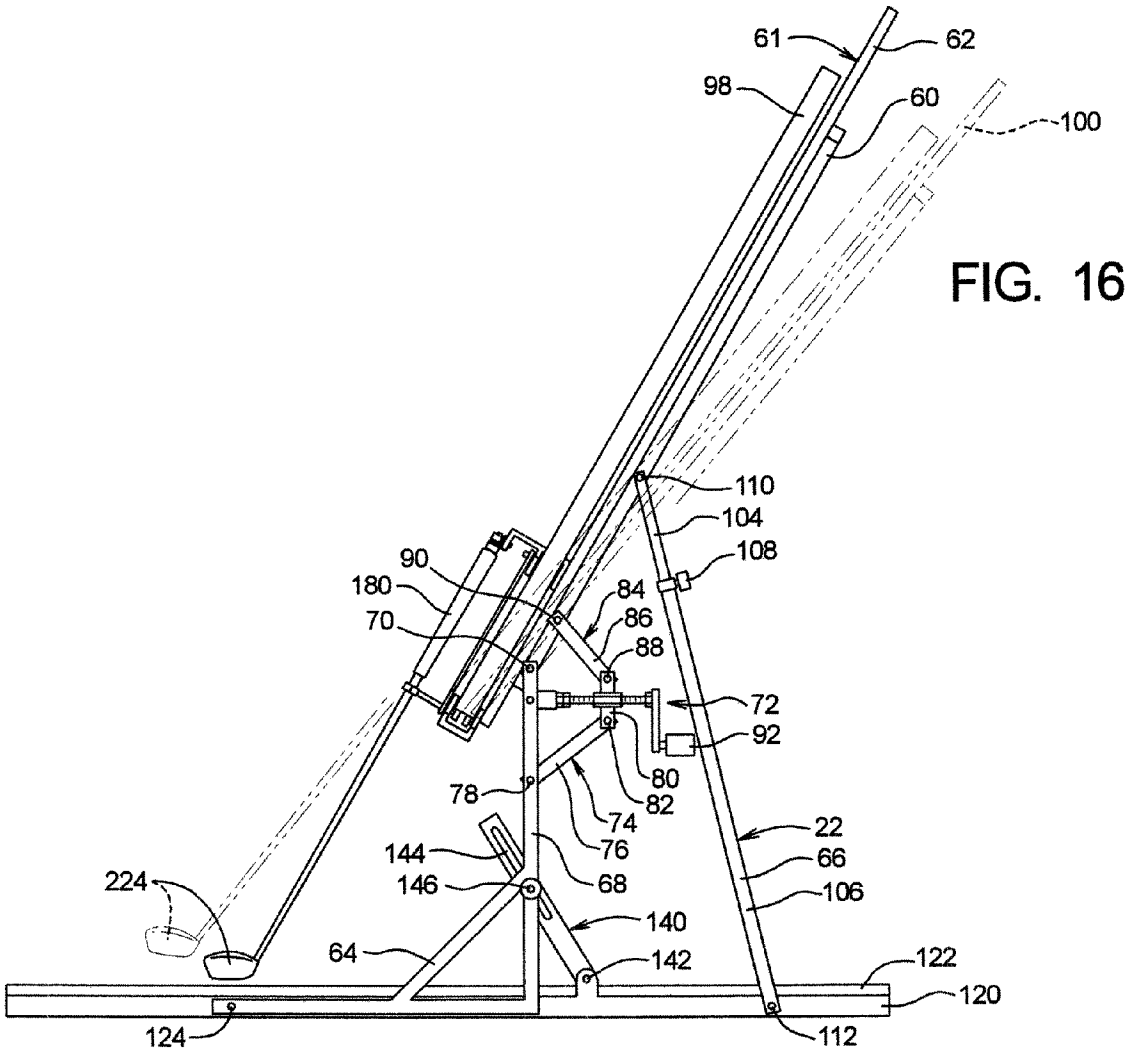
FIG. 16 is a side view of the golf swing training aid showing the adjustment system to adjust the swing plane.
Figure 17:
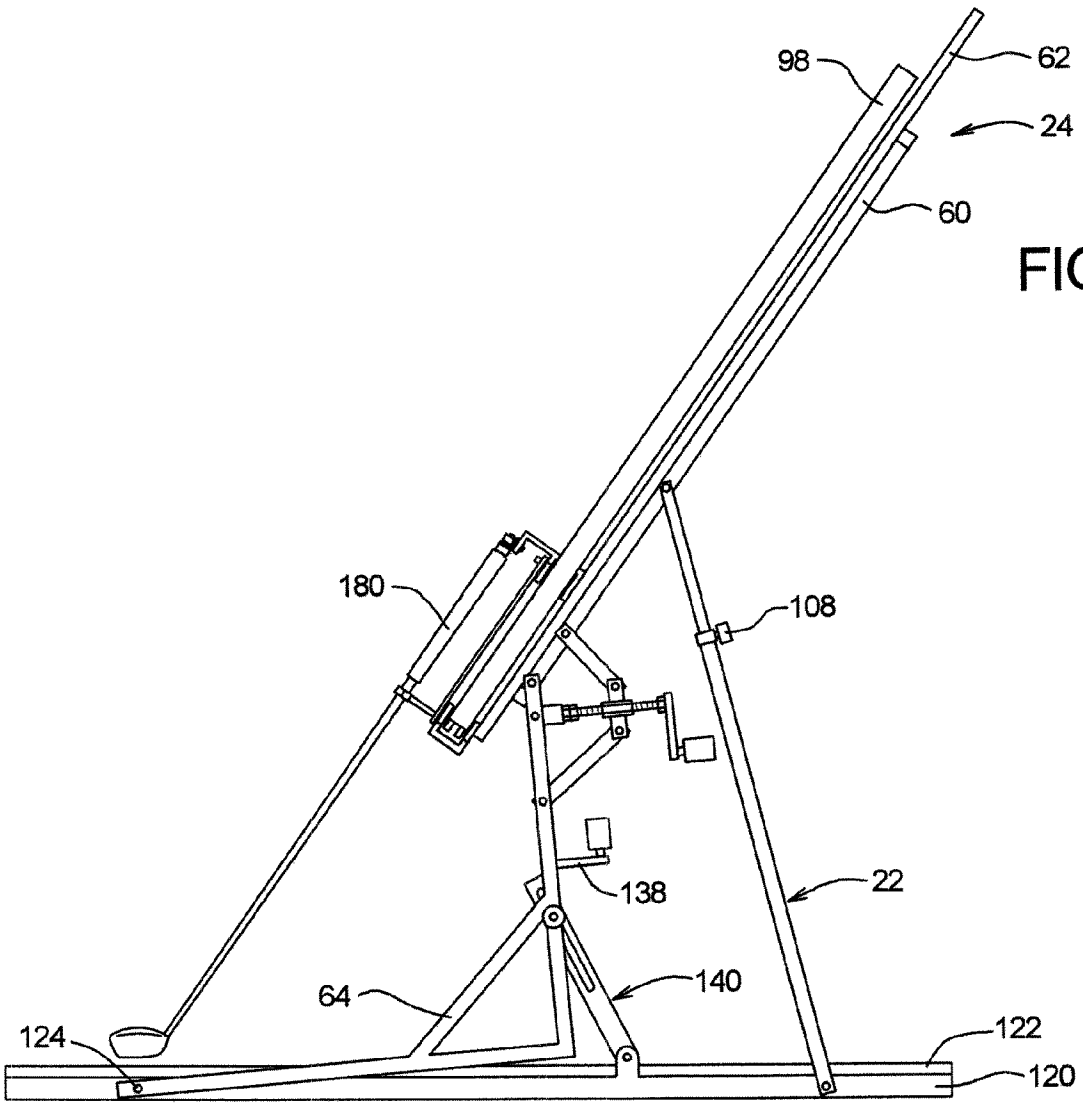
FIG. 17 shows the golf swing training aid where the vertical adjustment system has orientated the active area vertically to accommodate a taller golf student.

Skipping ahead to FIG. 16, the base frame 22 generally comprises a frame member 60 that as shown in FIG. 4, is adapted to connect to a base adjustment disk 62. A first support member 64 and a second support member 66 are pivotally connected to the frame member 60. In one form, the first support member having a substantially vertical portion 68 provides a pivot location 70. An adjustment system 72 is provided whereby a dual linkage assembly comprising a first linkage 74 that comprises the pivot member 76 which is pivotally connected to the substantially vertical portion at pivot attachment 78 and further the pivot member 76 is pivotally attached to the repositioning member 80 at pivot attachment 82. The repositioning member 80 is further a part of the second linkage 84 which further comprises an upper pivot member 86 that is pivotly attached to the repositioning member 80 and the frame member 60 at pivot locations 88 and 90 respectively. In one form, the repositioning member 80 is a crank and screw assembly whereby turning the handle 92 in a clockwise or counterclockwise manner adjusts the repositioning member 80 and essentially biases a force at the pivot attachment 90 to rotate the upper frame assembly 61 from a first position indicated at 98 to a second position indicated by the broken line 100 in FIG. 16. These various positions are adapted to provide a proper orientation of the swing plane for different golf students. The second support member 66 in one form has a telescopical extension 104 adapted to be received in the base portion 106. A locking mechanism 108 is adapted to fix the distance between the pivot attachments 110 and 112 whereby adding rigidity to the upper frame assembly when it is at its desired angle along the lateral direction as shown in FIG. 16.

Figure 18:
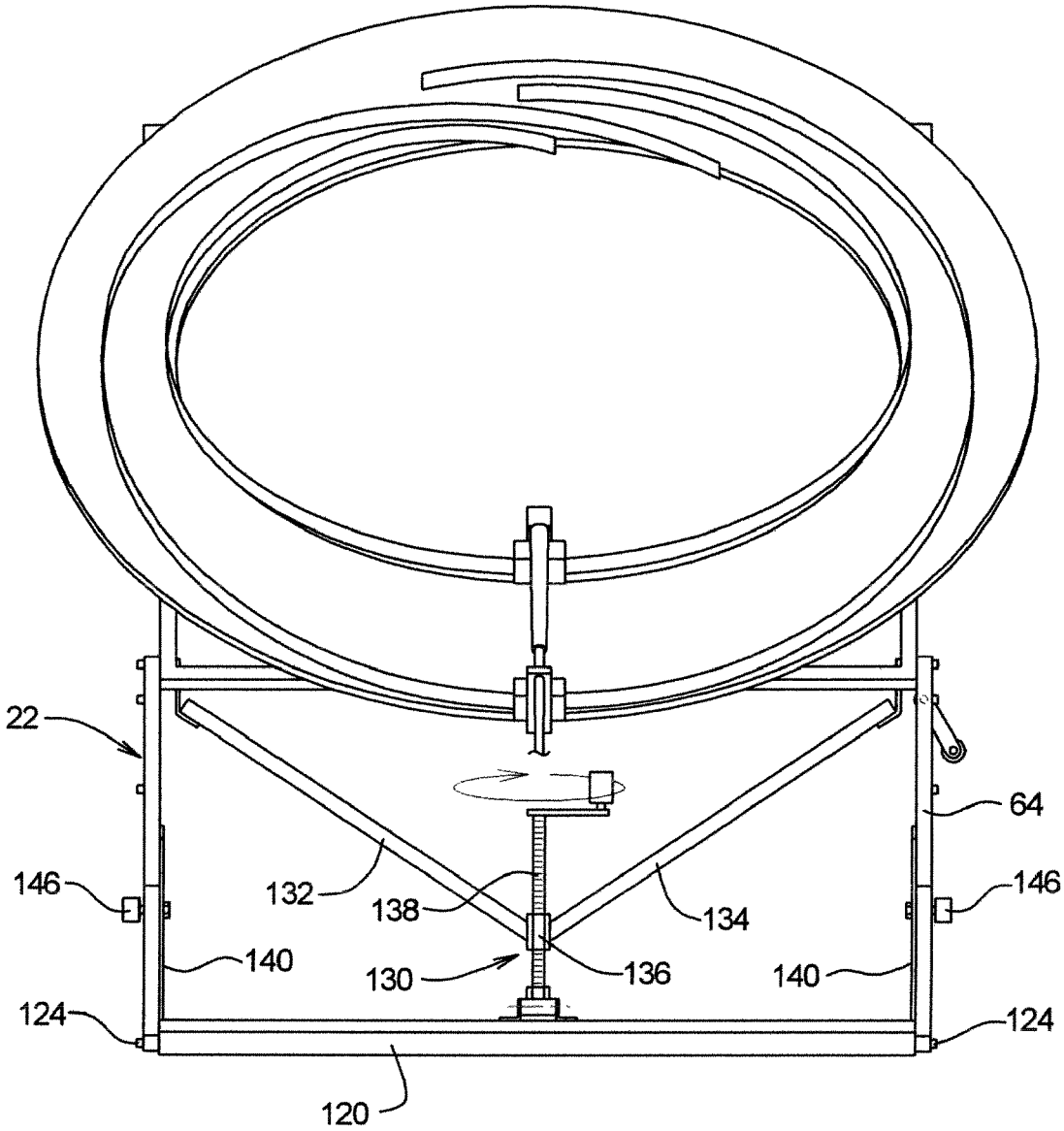
FIG. 18 is a front view showing the vertical adjustment system in one form.
Figure 19:
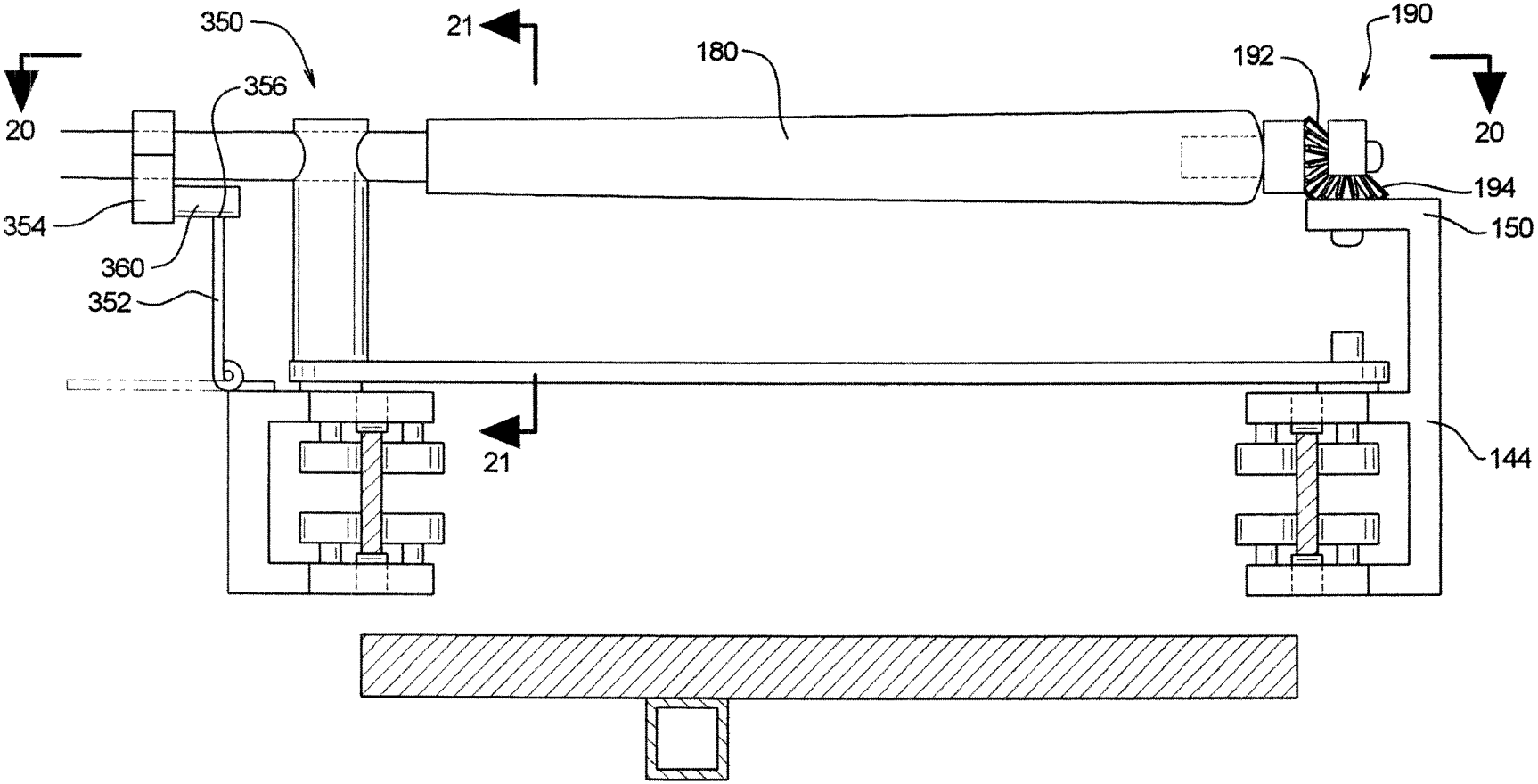
FIG. 19 is a side view of a second embodiment of a roll control system which is located in the lower portion of this figure.

The base frame 22 further comprises a base platform 120 that has an upper surface 122 that is adapted to support a golf student as shown in FIG. 1. The first support member 64 is pivotally attached to the base platform 120 at the pivot attachment 124. In one form, as shown in FIG. 18, the pivot attachment 124 is located on the lateral end portions of the base platform 120. Positioned in the center region of the base frame 22 is a vertical adjustment system 130 which comprises of support members 132 and 134 that are connected to a threaded positioning member 136. A central threaded member 138 is adapted to reposition the threaded positioning member 136 which in turn repositions the support members 132 and 134 in the vertical direction because the support members 132 and 134 are fixedly connected to the first support member 64.

Because the pivot attachment 124 is positioned near the head of the club 224 (see FIG. 16), when the vertical adjustment system 130, as shown in FIG. 18, is employed to adjust the overall height of the upper frame assembly 61, the distance from the club 220 and the upper support surface 122 does not substantially change. This provides for an adjustment in height whereby the club need not be altered to accommodate this adjustment.

A slide member 140 is also employed whereby the slide member is pivotally attached to the base platform 120 at pivot attachment 142. The slide member in one form comprises of an elongated adjustment slot 144 whereby the locking mechanism 146 is adapted to fix the distance from the pivot attachment 142 and the locking mechanism which forms an attachment location to the first support member 64.

There will now be a description of the carriage assembly 32 with initial reference back to FIG. 1.

It should be noted that the swing plane as defined by the first and second rails 34 and 36 need not necessarily be the exact position of these rails, but rather other intermediate links between the rail system 30 and the carriage assembly 32 can be employed. In one form, the rail system 30 is formed of two distinct rails 34 and 36. However, other forms can be employed whereby the first and second rails 34 and 36 are essentially guiding tracks which may or may not be directly connected. It is desirable to have such tracks adjustable to accommodate various students of golf. Referring back to FIG. 3, the plurality of connectors 50 and 52 for the first and second rails 34 and 36 are positioned at various quadrant locations along the swing path of the rail system 30. As shown in FIG. 4 the connection members 50*a* and 52*a*, 50*d* and 52*d*, 50*e* and 52*e* and finally 50*f* and 52*f* provide for adjustment whereby a plurality of adjustment slots 51*a* and 53*a*, 51*d* and 53*d*, 51*e* and 53*e* and finally 51*f* and 53*f* are provided for in the base adjustment disk 62. As shown in FIG. 4, these adjustment slots are positioned in an arc like manner to accommodate the general expansion of the first and second rails 34 and 36. It is desirable to have this type of adjustment for accommodating different students that have different shoulder builds and arm lengths.

As shown in FIG. 1, the student of golf 26 is positioned in the central open area 63 (see FIG. 2) of the upper frame assembly 61. The student 26 is grasping the golf clublike handle 180 and is prepared to practice his or her golf swing. The golf clublike handle 180 is a part of the carriage assembly 32 which will now be described in detail. In general, the carriage assembly 32 is adapted to cooperate with the rail system 30 whereby the rail system directs the path of travel in the course of the swing path. The golf clublike handle 180 in one form can have a "reminder grip" that has the thumb and fingers fit in the recommended as the most recommended position on the club.

In general, the carriage assembly 32 performs a variety of operations whereby a the basic operations of the carriage assembly 32 is to provide a desirable pitch of a golf clublike handle 180. In general, pitch is defined as the rotation of the golf clublike handle 180 about the forward-rearward axis 14 (see FIG. 1 showing the axis 14). As described further herein in detail in FIGS. 9-16, during the course of a golf swing, the club rotates about the forward-rearward axis where essentially the golf student breaks his or her wrist rearwardly in the backstroke and at a certain location during the stroke breaks the wrist forwardly whereby approximately near the contact of the ball there is a forward break that continues as the golf student drives his/her hips through the stroke. What is commonly referred to as the release area is the point where the wrist is broken.

A second aspect of the carriage assembly in one form is to further include a roll control system 190 that is adapted to regulate the proper amount of roll of the club in the course of a swing. In general, roll is defined as the rotation of the golf clublike handle about the longitudinal axis 186 of the club (see FIG. 5). The longitudinal axis of the club is roughly in line with the transverse axis 10 as shown in FIG. 1 at the bottom dead center location. As described in great detail below with reference to FIGS. 11-15B, in one form, the golf training aid 20 is adapted to have the golf clublike handle 180 roll with respect to various positions in the course of a golf swing. In a second embodiment as described in reference to FIGS. 21-23 below, there is shown a different roll control system adapted for an alternative golf swing technique.

Figure 5:
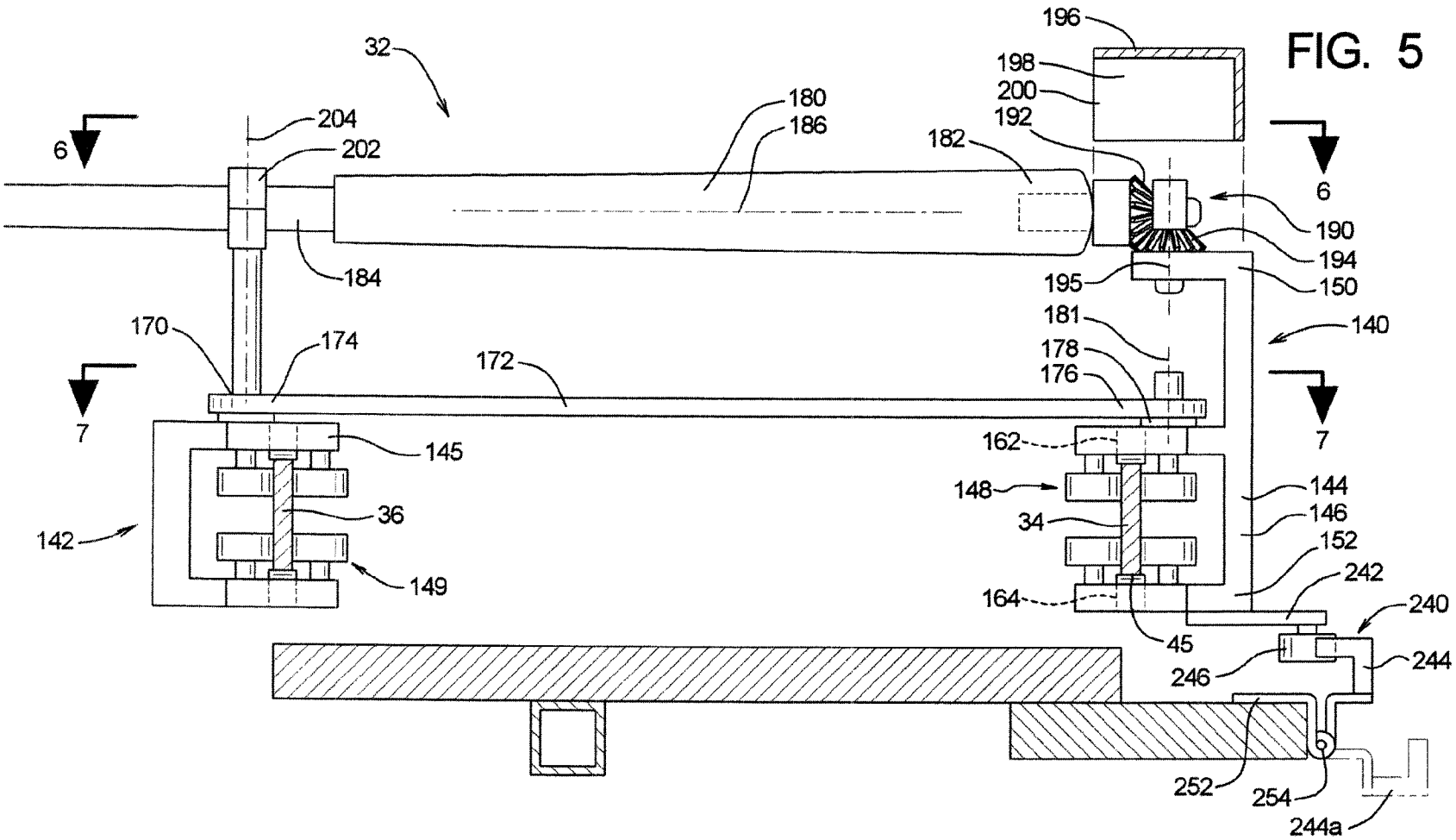
FIG. 5 is a partial cross sectional side view of the carriage assembly.

There will now be detailed description of the carriage assembly 32 with initial reference to FIG. 5. The carriage assembly 32 comprises a first attachment region 140 and a second attachment region 142 the first attachment region 140 is slidably attached to the first rail 34. In a likewise manner the second attachment region 142 of the carriage assembly 32 is slidably attached to the second rail 36 that is shown in cross-section in FIG. 5. In general, slidably attached is defined as being confined to the guided track of the first and second rails 34 and 36 but adapted to move with ease therearound. Of course other forms other than physical sliding can be executed such as some form of an air bearing or the like or any other foreseeable assembly and all such methods of connecting are defined under the term, "slidably attached". In one form, a bearing system as described below is well adapted to handle the various forces imparted upon the carriage assembly and allow the carriage assembly 32 to freely move along the rail system 30 which as described above is comprised of the first and second rails 34 and 36.

Figure 6:
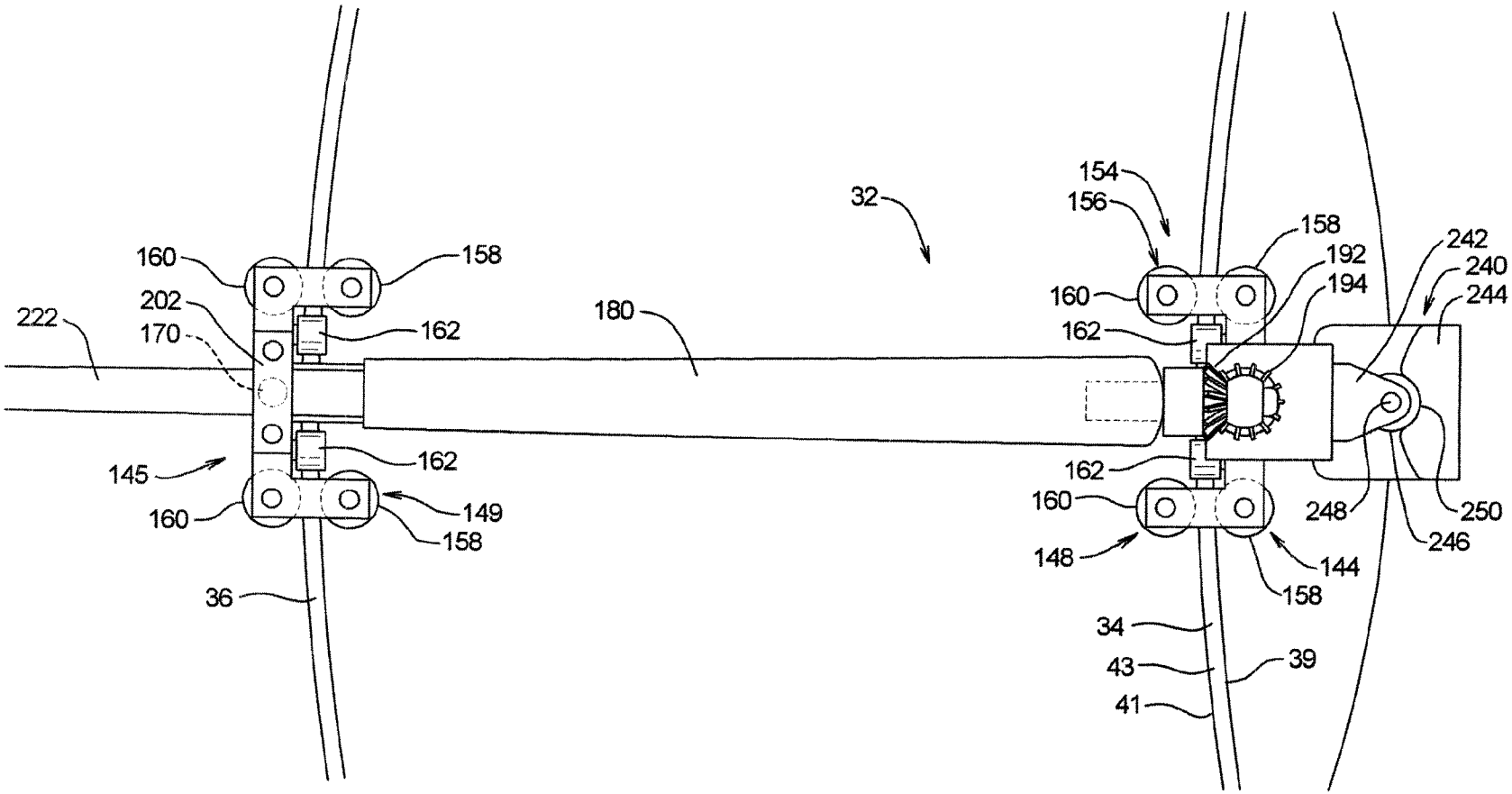
FIG. 6 is a front view of the carriage assembly in a bottom dead center position showing the pitch transition system in the upper portion.

The first connection region 140 in one form is comprised of a first carriage 144. The first carriage 144 comprises a frame member 146 and a first bearing assembly 148. The frame member 146 has an upper region 150 and a lower region 152. As shown in FIG. 6, the first bearing assembly 148 of the first carriage 144 in one form is comprised of a leading set of bearings 154 and a trailing set of bearings 156. The leading and trailing bearings 154 and 156 in one form each comprise of transverse inward bearings 158 and transverse outer bearings 160. The transverse bearings 158 and 160 are adapted to engage the radially inward and radially outward surfaces 39 and 41. The first bearing assembly 148 further comprises of forward-rearward axis stabilizing bearings whereby as shown in FIG. 5, the upper bearing 162 is adapted to engage the upper surface 43 of the first rail 34 and the lower bearing 164 is adapted to engage the lower surface 45 of the first rail 34. As with the bearings 158 and 160, the upper and lower bearings 162 and 164 have leading and trailing bearing pairs as shown in FIG. 6.

The second carriage 145 comprises of the second bearing assembly 149. The second bearing assembly 149 is similar to that as the first bearing assembly 148 and hence the description of the components of the first bearing assembly 148 is relevant to the second bearing assembly 149 where similar bearing pairs are herein identified by similar names in reference numerals. The second carriage 145 comprises a pivot attachment 170 that is adapted to engage the club grasping member 202 described below.

The carriage assembly 32 further comprises in one form a support bar 172 which is pivotally attached to the pivot attachment 170 of the second carriage 145 at a second end 174 of the support bar 172. The support bar 172 further has a first end 76 that is pivotally attached to a pivot attachment 178 of the first carriage 144. The pivot attachment 178 has a center axis of rotation 181 that is in line with the center of rotation 195 of the roll control system 190 described herein. It should be noted that the support bar 172 is not essential for the basic operation of the carriage assembly 32; however, it provides extra support to the carriage assembly 32 during the motion and various accelerations acting thereon when the carriage assembly is in use by a golf student.

Figure 11:
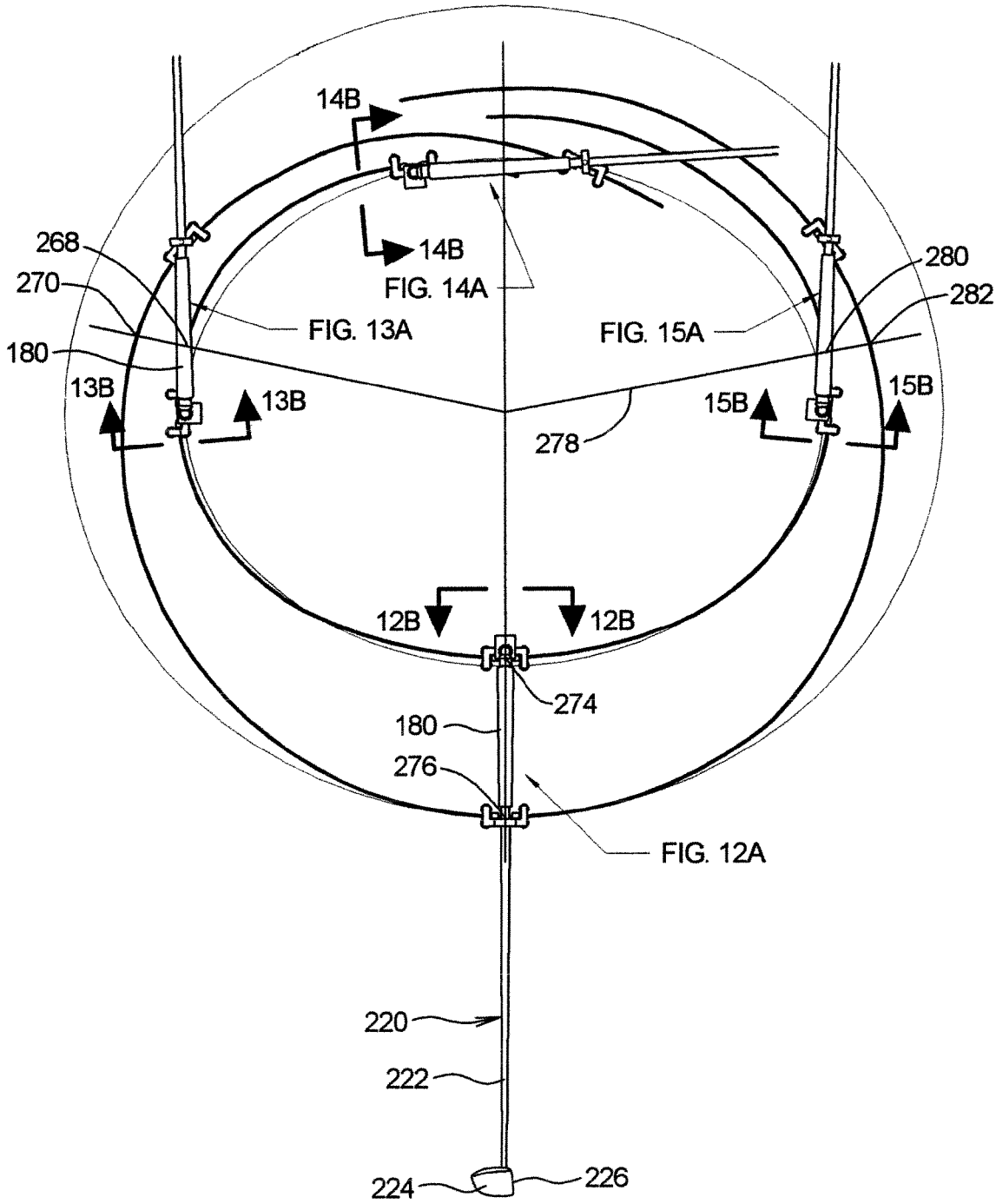
FIG. 11 schematically shows positions of the carriage assembly with respect to the first and second rails where the carriage assembly is approximately at twelve o'clock, nine o'clock, six o'clock and three o'clock positions.
Figure 12A:
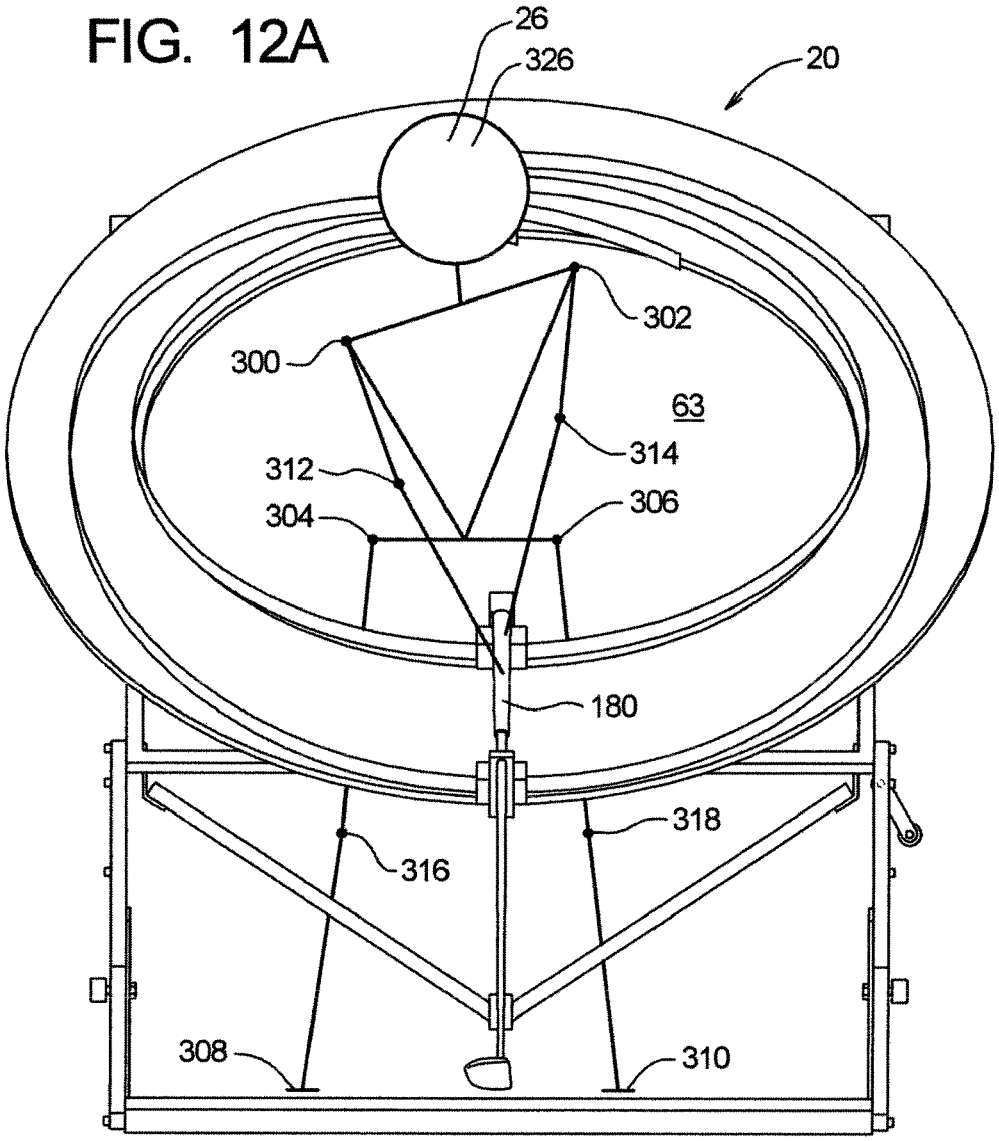
FIG. 12A schematically shows a student golfer grasping the golf clublike handle of the carriage assembly at the bottom dead center location (six o'clock location)

The carriage assembly 32 further comprises a golf clublike handle 180 having a club longitudinal axis 186, a first handle region 182 and a second handle region 184. The first region 182 is connected to a roll control system 190. As mentioned briefly above, the roll control system is adapted to control the roll of the golf clublike handle 180 about the clubs longitudinal axis 186. The roll control system 190 in one form comprises a club headgear 192 and a carriage gear 194. The carriage gear 194 has a central axis 195 which should be substantially aligned with the central axis of rotation 180 of the pivot attachment 178 as shown in FIG. 5. The gears 192 and 194 are bevel like gears having a plurality of teeth and recessed regions adapted to engage opposing recessed and toothed regions of the related gear whereby as the golf clublike handle 180 pitches rearwardly in a matter as illustrated in FIG. 11 in the left-hand portion, (whereby FIGS. 13A and 13B are detailed illustrations thereof), the club will pitch rearwardly and because the first carriage 144 is perpendicular to the local surface of the first rail 34; as the club pitches rearwardly it will rotate to open the club face (front impact face 226). This process is described immediately following this paragraph with reference to FIGS. 11-15B. Referring back to FIG. 5, an optional cover that is shown in partial cross-section 196 can be attached to the upper region 150 of the first carriage 144. The cover 196 has a central chamber region 198 and a forward open area 200 whereby the chamber region 198 is adapted to house the roll control system 190 and protect the golf student from getting material or skin caught in the gear system during the course of a swing.

The golf clublike handle 180 is further attached to the golf club grasping member 202. It should be noted that the golf club grasping member 202 has a central axis 204 whereby the distance from the central axis 204 and the central axis 195 (as well as the center axis of rotation 181 of the pivot attachment 178) are a fixed distance from one another whereby the pitch of the club is dictated by adjusting the radial distance between the central axis 204 and the central axis 195. The radial distance between the center axis 195 and 204 is adjusted by the radial spacing between the first rail 34 and the second rail 36, where as shown in FIG. 6, the distance between the first and second rails 34 and 36 is at a maximum distance and the golf clublike handle 180 is generally in line with the radial lines of the rail assembly 30 as shown in FIG. 4.

In one form, the golf clublike handle 180 is a part of an actual golf club whereby as shown in FIG. 11, the club 220 comprises a shaft 222 and a golf head 224. The golf head has a front impact face 226. Although it is desirable to have an actual golf club employed, it is not necessary and the important portion is the handle 180. However, it is desirable to have a full golf club or the like whereby the golf swing training aid 20 can be used to actually hit golf balls with a high degree of success in the realm of accuracy and distance (as well as preventing such common problems such as slicing and hooking).

Figure 7:
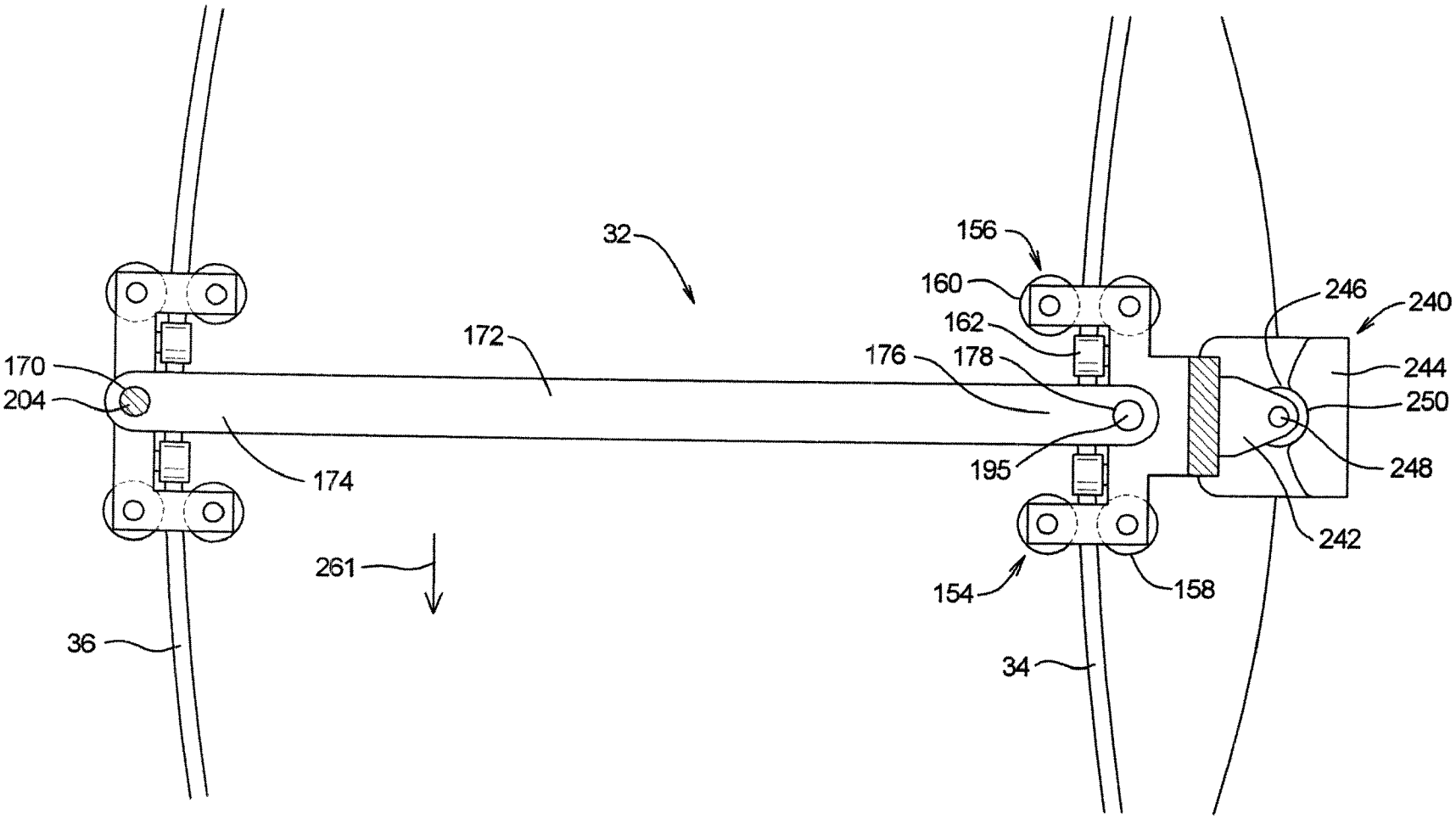
FIG. 7 is a partial cross sectional view of the carriage assembly showing the optional support bar connecting the first and second carriages.
Figure 7A:
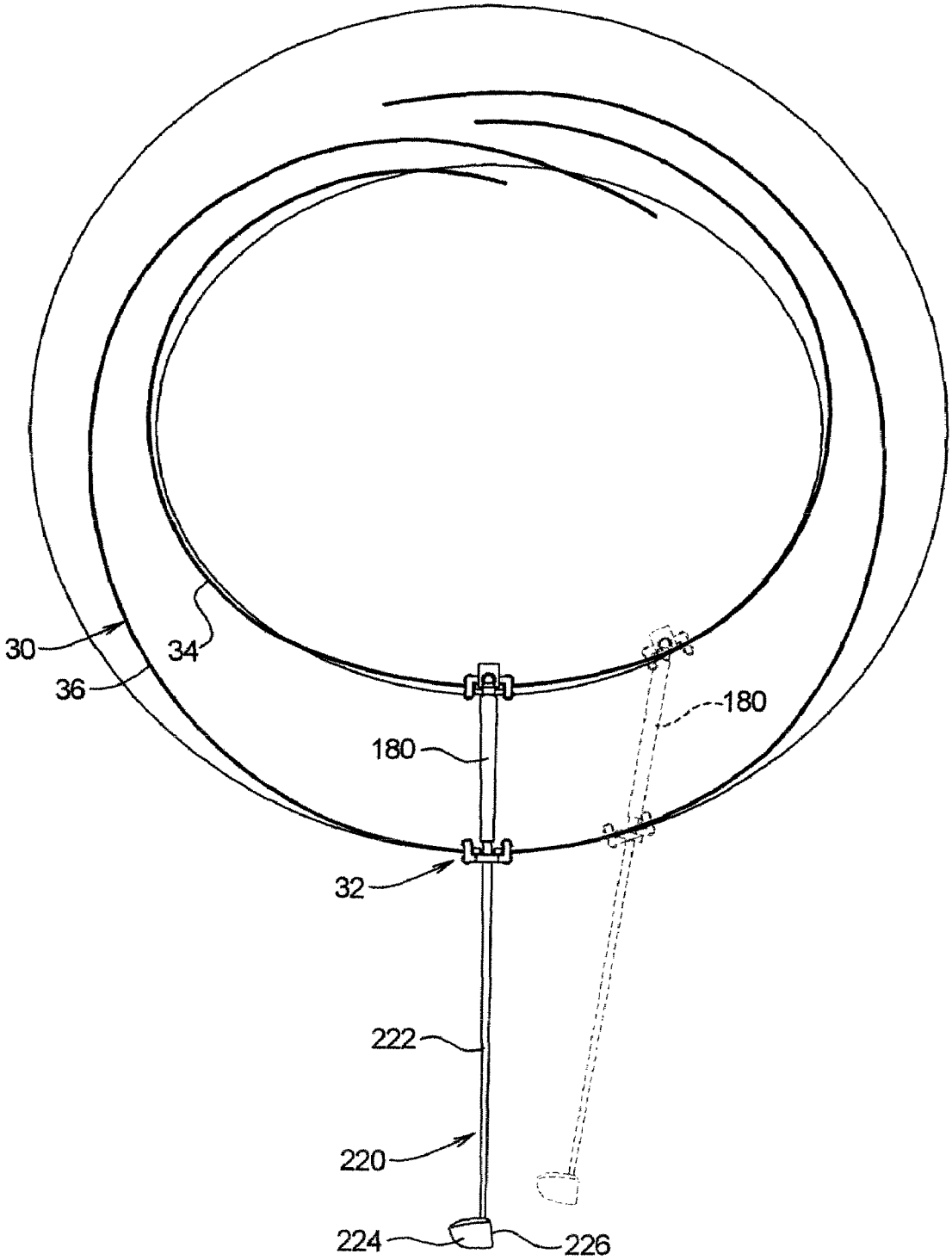
FIG. 7A shows the potential orientation of the carriage assembly with respect to the rail system which can potentially incorrectly occur when the pitch transition system is not employed for a beginner golfing student.
Figure 8:
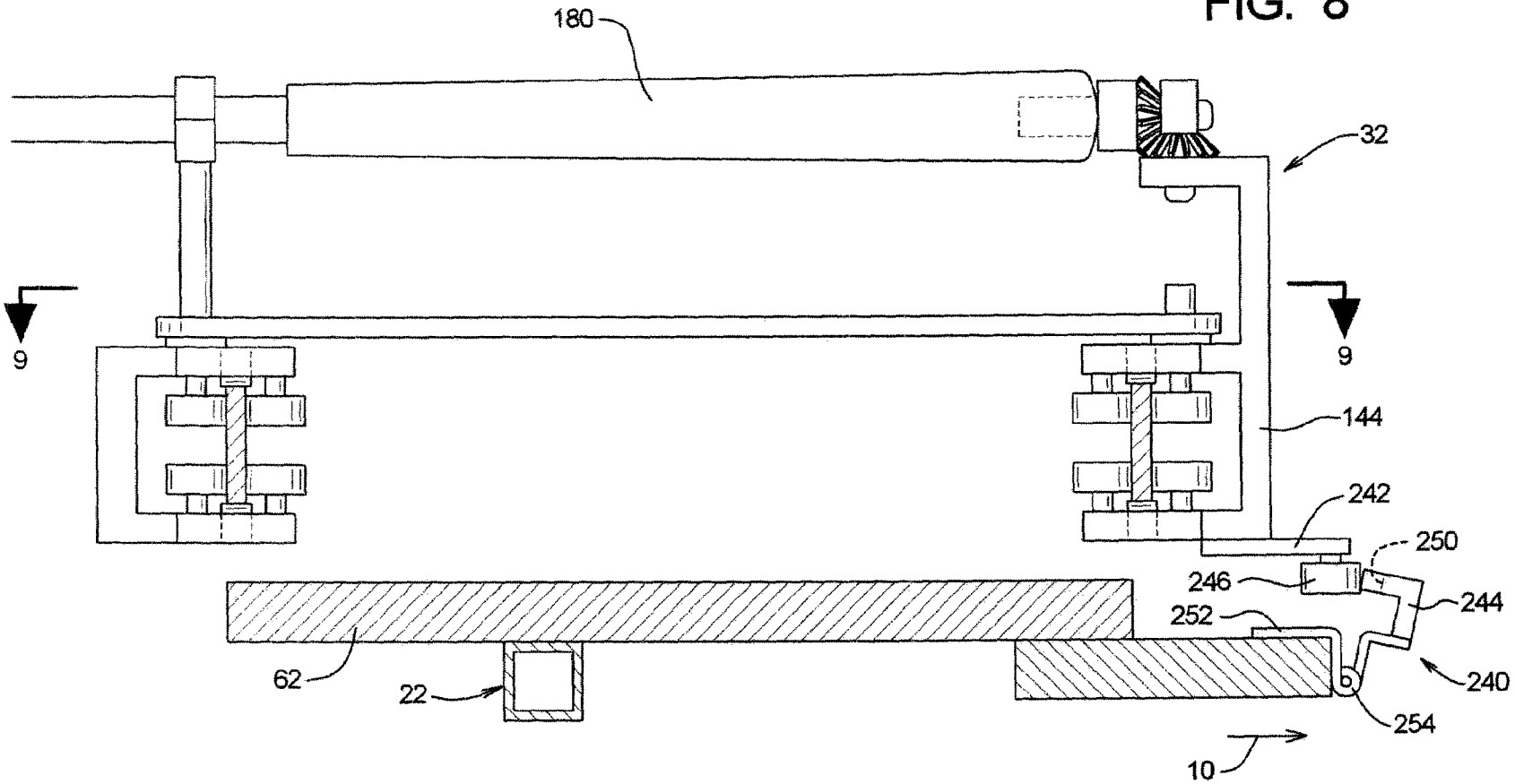
FIG. 8 is a partial side cross sectional view of the carriage assembly whereby the pitch transition system at a second stage of the pitch transition whereby in one form the engagement member is repositioned vertically to accommodate the location of the pivot member.
Figure 9:
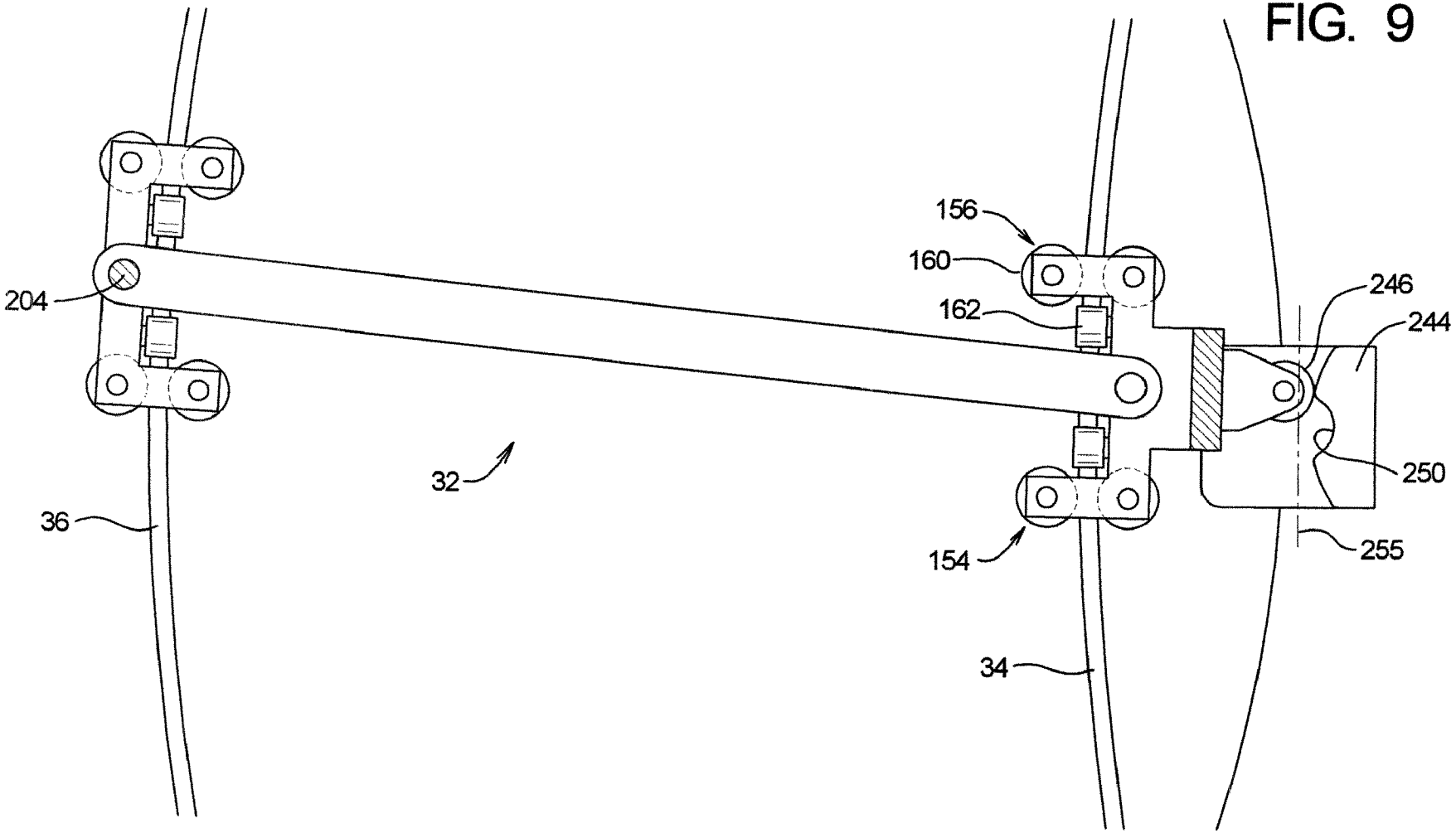
FIG. 9 is taken at line 9-9 of FIG. 8 whereby the carriage assembly is in the second stage of a pitch transition.

The discussion of the components will now finish with a detailed description of the pitch transition system 240. As generally referred to above and described in detail herein below, the golf clublike handle 180 is adapted to pitch at various locations in the swing. In general, between the golf swing positions of eleven o'clock and the six o'clock positions is defined as a rearward pitch region and between the six o'clock end one o'clock positions is generally defined as the forward pitch region. At the bottom dead center location as shown in FIGS. 6 and 7, in a normal swing the golf club pitches forwardly as the golfer engages in a proper follow-through. However, experience has shown that in some cases without a pivot transition system 240, the carriage assembly could potentially be positioned in a matter shown by the broken lines at the five o'clock position in FIG. 7A. It should be noted that this is a very undesirable orientation of the carriage assembly 30 and generally not ergonomically feasible if the golf student is to maintain a grasp on the golfclub like handle 180. However, this orientation is possible given the linkage structure and the fact that the first and second rails 34 and 36 have an approximate maximum radial distance at the bottom dead center position as shown at the six o'clock position in FIG. 7A. The maximum radial distance is defined as a distance that corresponds to the substantially fixed distance of the first and second attachment regions 140 and 142 of the carriage assembly or such a distance to facilitate a pitch transition. Of course the first and second attachment regions 140 and 142 do not need to be a absolute rigid distance from one another, but rather a substantially fixed distance from one another so the pitch control of the golf clublike handle 180 can function with respects to the rail system 130. Therefore, it is apparent that it is very desirable to have a transition period at the six o'clock portion of the swing whereby the pitch goes from a rearward to forward slant about the forward-rearward axis and this transition occurs approximately at the point of contact with a ball or in the general area near the six o'clock portion of the swing. In general, the pitch transition system 240 comprises a pivoting member 242 and an engagement member 244 as shown in FIG. 6. The pivot member 242 in one form comprises of a wheel 246 pivotally attached at a pivot location 248 and as shown in FIGS. 6 and 8, the wheel 246 is operatively connected to the first carriage 144. Also shown in FIGS. 6, 7 and 8, the engagement member 244 comprises a pivot detent 250. In a preferred form, the engagement member 244 is movably and biasedly attached via a spring member 254 to the base frame 22 whereby in one form it is attached to a J-member 252 which in turn is fixedly attached to the adjustment disk 62. The spring member 254 is not absolutely necessary if the tolerances of the system are very tight; however, in practice it has been found that having a certain amount of adjustment in the transverse direction 10 is desirable whereby a larger pivot detent 250 can be provided which supplies a sufficient amount of drag so the momentum and inertia of the carriage assembly brings the carriage assembly to a forward pitched orientation as shown at the three o'clock position in FIG. 11.

Figure 10:
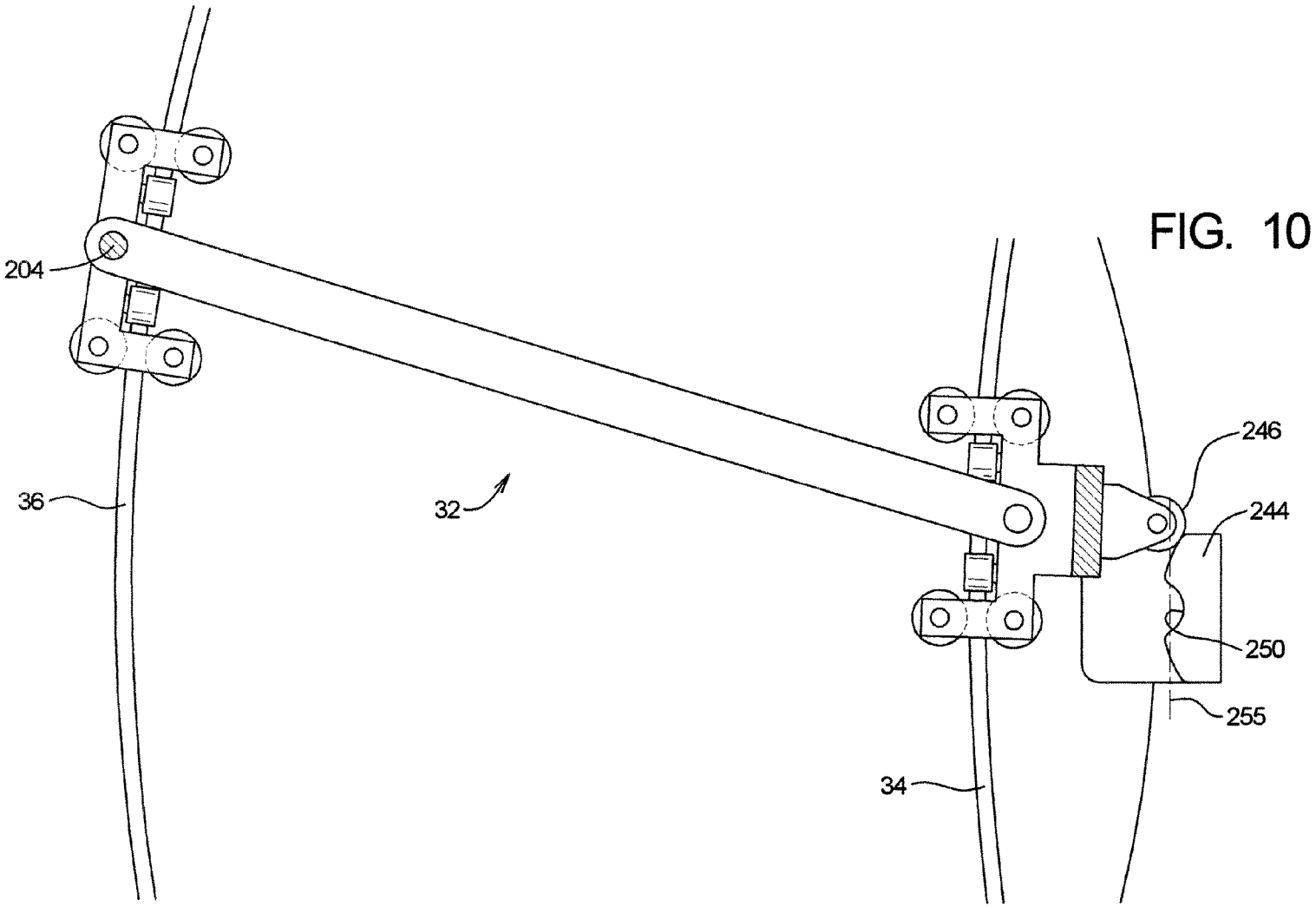
FIG. 10 shows a pre-transition orientation of the carriage assembly whereby the pitch transition system is in a first stage and the pivot member is about to engage the engagement member.

For example, as shown in FIG. 10 the carriage assembly 32 is in a pre-transition orientation whereby the wheel 246 is engaging the rearward portion of the engagement member 244. Now referring to FIG. 9, the carriage assembly 32 is still in a pre-transition orientation but the wheel 246 is engaging the rearward crest of the pivot detent 250. As shown this figure, the engagement member 244 is positioned slightly vertically with respect to a reference line 255. FIG. 8 shows a partial sectional view of the orientation of the carriage assembly 32 in FIG. 9 whereby the engagement member 244 is positioned vertically upward and the wheel 250 is biasing the engagement member 244 in that direction. Now referring to FIG. 7, the carriage assembly 32 is in a transition orientation whereby the wheel 246 is fully engaged in the pivot detent 250 and given the resistance of the engagement member 244 to reposition vertically, the lower portion of the golf clublike handle 180 will continue to move in the forward direction as indicated by the arrow 261 and for a brief moment will rotate about the pivot location 248 of the wheel 246. It has been found that the pitch transition system 240 works very effectively to aid in the transition from a rearward pitch to forward pitch at the six o'clock position in the swing. As shown in FIG. 5, if the student no longer needs to have such a transition system in the course of the swing, the engagement member 244 is adapted to reposition to the location indicated at the hatched line 244A.

With the foregoing description of the various assemblies, subassemblies and components in mind, there will now be a description of a method of using the golf swing training aid 20 referring to FIGS. 11-15B.

FIG. 11 shows various positions and orientations in the course of a golf swing. Referring back to FIG. 4, a plurality of radial reference lines are shown where the twelve o'clock position of the reference line 260 has an approximate radial distance between the first and second rails 34 and 36 at the intersection points 262 and 264 respectively. Further, generally at the nine o'clock—nine thirty position the radial reference line 266 has intersect points generally indicated at 268 and 270. Now referring to the lower portion at approximately the six o'clock position, the radial reference line 270 has intersect points at the first and second rails at 274 and 276 which is the maximum radial distance. Finally, the reference line 278 at the two thirty-three o'clock position, the intersect points for the first and second rails are generally at 280 and 282. Now referring to FIG. 11, the radially extending reference lines 260, 266, 272 and 278 generally indicate the center points between the first and second carriages of the carriage assembly at various positions in the course of a swing. As indicated in FIG. 11, when the radial distance between the first and second rail is decreased, the pitch of the golf clublike handle 180 is increased. For example, as indicated in FIG. 11 at the nine o'clock position, the general intersect points 268 and 270 are closer in proximity together than the intersect points 274 and 276 at the six o'clock position. Hence, there is greater rearward pitch of the clublike handle 180 at the nine o'clock position in the rear stroke. Of course the amount of pitch can be adjusted by adjusting the relative distances between the first and second rails 34 and 36 in a manner as described above in reference to FIG. 4.

Therefore, it is apparent that FIG. 11 generally indicates the various positions of the carriage assembly 32 in the course of a full swing. FIG. 12A indicates a starting swing position whereby the golf student 26 is grasping the golf clublike handle 180 with a proper grip. The golf student 26 has a right shoulder pivot point location 300 and a left shoulder pivot point location 302. In one form of a golf swing the right shoulder portion 300 is slightly dipped lower than the left shoulder 302. The pivot points of the golf student 26 generally indicate a kinemetic diagram of the biomechanical motions of the golf student 26 in the course of swing. The golf student 26 further has a right hip pivot location 304 and a left hip pivot location 306. It is desirable to have the golf student 26 begin in a relaxed position grasping the golf clublike handle in a proper orientation and height as it would when they are not using the golf training aid 20. Of course as described above in reference to FIG. 18, the golf swing training aid 20 can be adjusted to adjust the golf swing plane, the height of the active area 24 (see FIG. 1) and the carriage assembly 32 to properly fit the golf student 26. Further, as described above in reference to FIG. 4, the width of the oval like dimensions of the first and second rails 34 and 36 comprising the rail system 30 can be properly adjusted given the length of arms and width of the torso of the golf student 26.

Figure 12B:
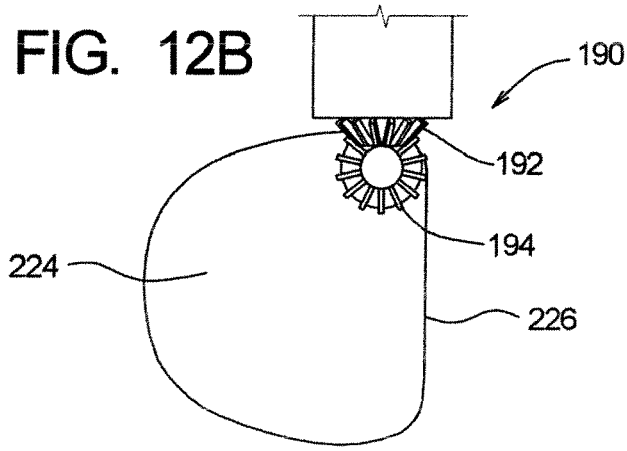
FIG. 12B is taken along line 12B-12B of FIG. 11 whereby the clubhead is in a squared position and adapted to engage the golf ball.
Figure 13A:
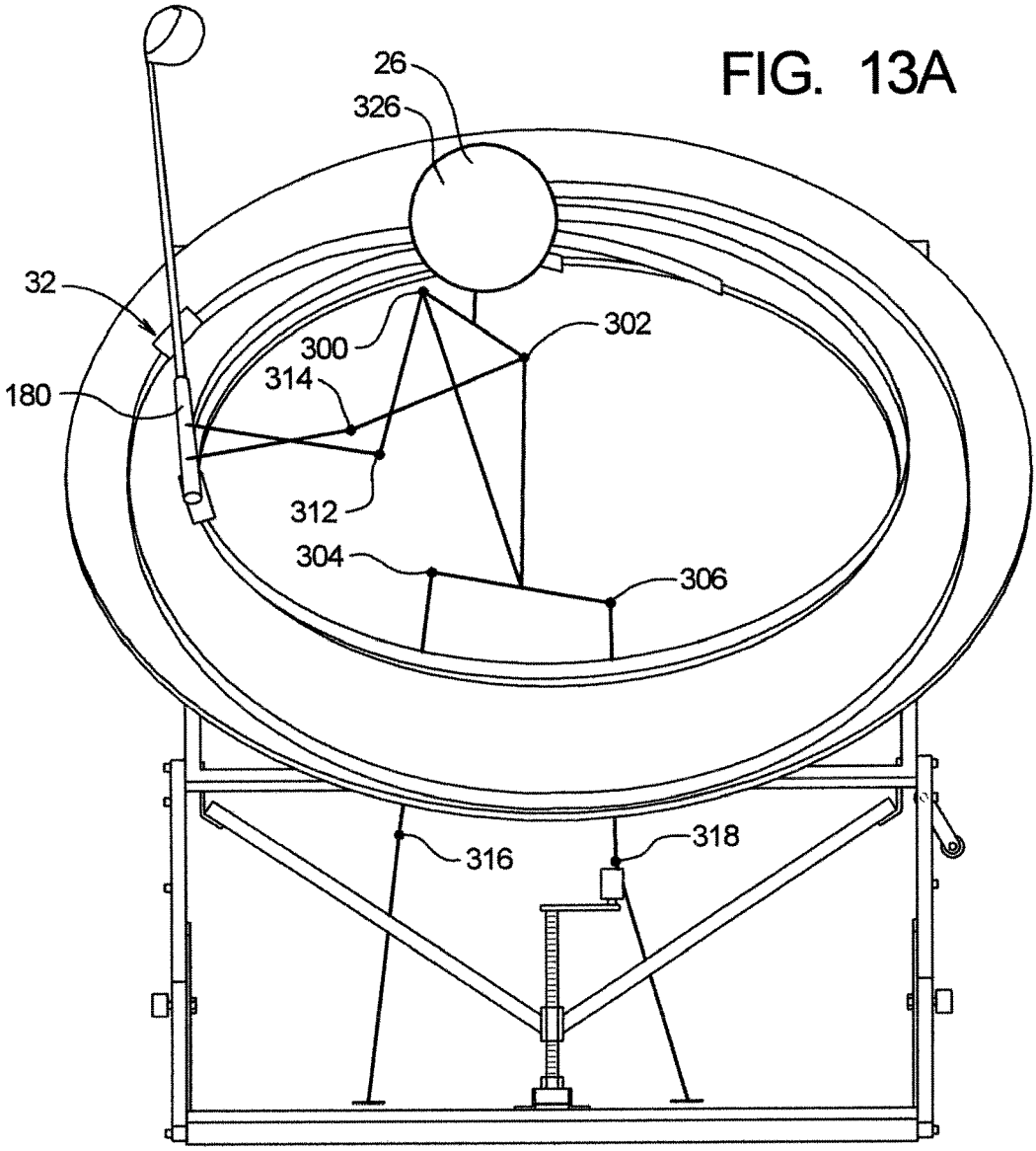
FIG. 13A shows a golf student with the golf club approximately at the nine o'clock position whereby the arrangement of the first and second rails allows for a desired amount of rearward pitch.
Figure 13B:
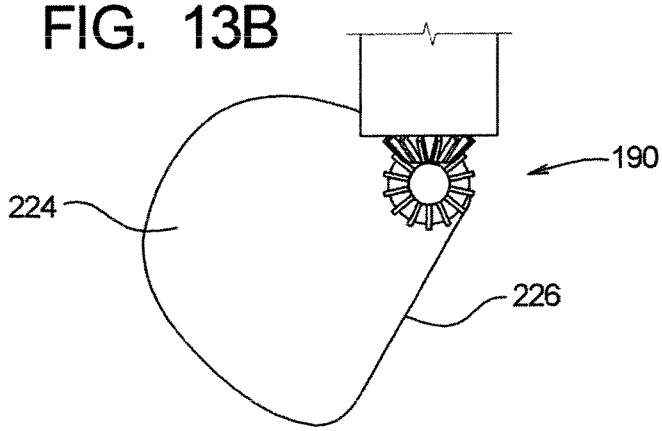
FIG. 13B is taken along line 13B-13B of FIG. 11 whereby the roll control system is adapted to roll the head of the club to an open orientation corresponding to the amount of rearward pitch of the club.

Once the golf training aid 20 is properly adjusted, and the golf student 26 is positioned in the central open area 63 of the adjustment disk 62, the student 26 grasps the golf club handlelike region 180 and the roll control system 190 as described above with reference to FIG. 5, maintains the roll of the club 3 positioned as shown in FIG. 12B whereby the club face 226 of the clubhead 224 is at a ball impact orientation where it is substantially square to the alignment of the feet 308 and 310 of the golf student 26 (substantially perpendicular thereto notwithstanding the vertical rearward declination to give the ball lift upon impact).

Now referring to FIG. 13A, the golf student is in the rearward swing at approximately the nine o'clock location whereby the left shoulder 302 is dipped downwardly to some degree and the right hip pivot region 304 is positioned back and rearwardly. The right shoulder 300 is raised and pulled rearwardly where the right elbow 312 is bent and the left elbow 314 is maintained in a straightened extended position as much as possible. The left knee 318 is generally slightly bent in this rearward stroke position. It is desirable to have the head 320 of the golf student 26 to remain substantially stationary and not bob up and down in the course of the swing. One advantage to having the golf swing training aid is that an instructor observing the student 26 does not have to be concerned about plane of the swing, pitch or roll of the club for these items only have one degree of freedom in the course the motion and hence one orientation for each segment of the swing. Because the carriage assembly and the golf clublike handle 180 has a certain orientation for every portion in the course of swing, a trainer observing the golf student 26 can focus on other aspects of the golf student such as his or her body position.

Figure 14A:
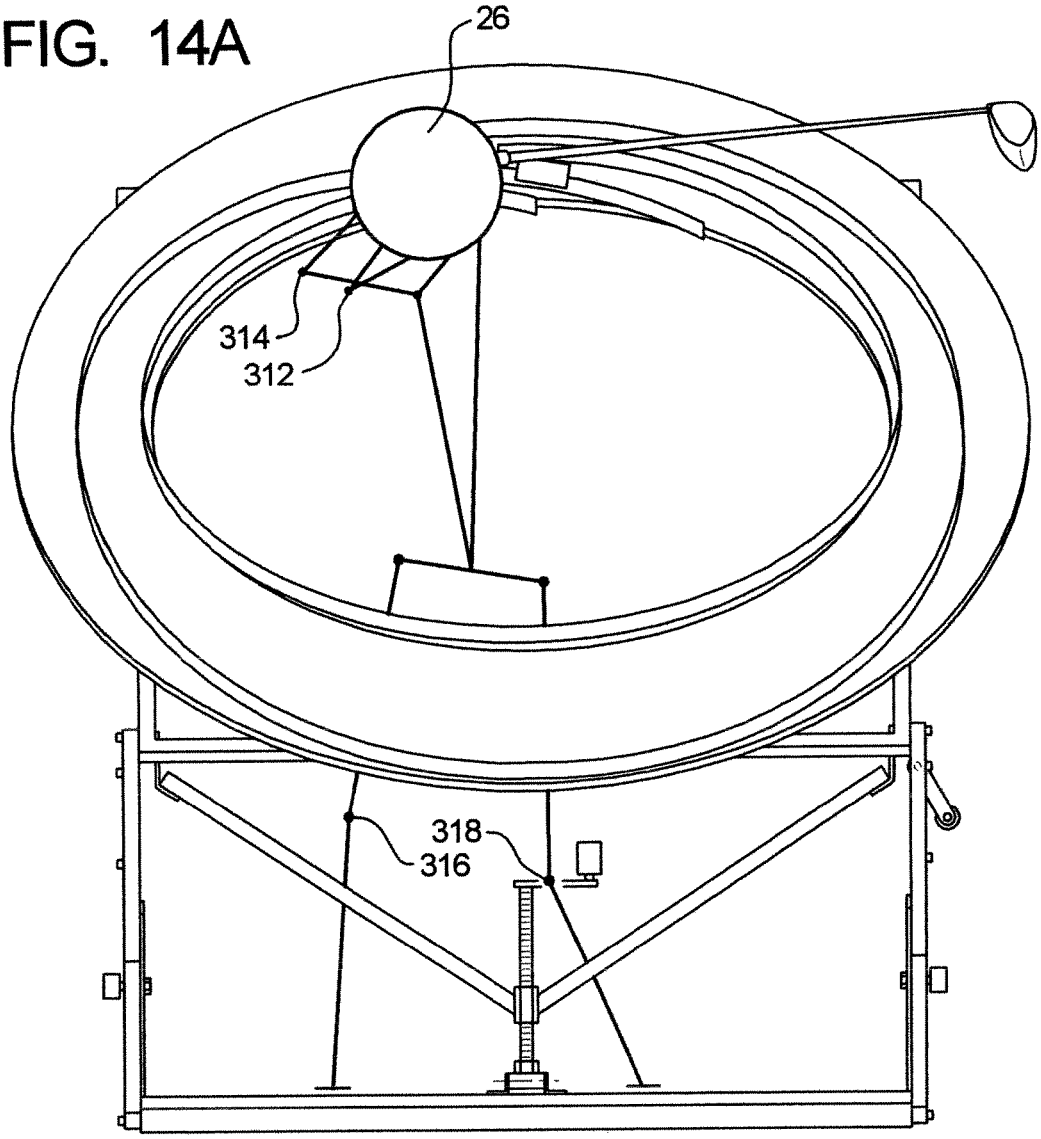
FIG. 14A shows a golf student in a full rearward portion of the swing at approximately the twelve o'clock location.
Figure 14B:
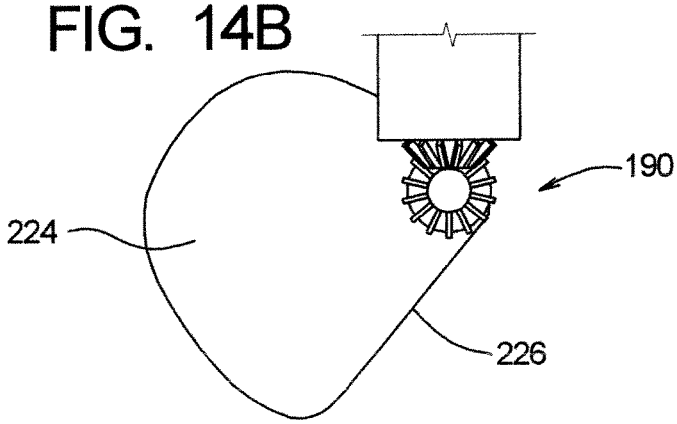
FIG. 14B is taken along line 14B-14B of FIG. 11 and shows the roll control system orientating the clubhead in a full open orientation.

Now referring to FIG. 14A, it can be seen that the golf student 26 is at a full rearward cocked position near the twelve o'clock orientation and the golf club face 226 of the golf head 224 is opened up and rolled to a very open position. Although it is desirable for the golf student to maintain a straight left elbow 314, is not always practical and hence the golf student 26 can get a feel for what it is like to have a full rearward swing where the golf clublike handle is maintained in the proper position of the swing plane.

In the downward swing, the golf student would be positioned in a similar manner as that as shown in FIG. 13A. Because the carriage assembly and the golf clublike handle 180 has a single orientation at every location during the swing, FIG. 13 looks similar in the upward stroke as well as the downward forward stroke. Of course the body orientation may be slightly different and a trainer training the golf student 26 may reposition the various body portions to accommodate the trainers desire for a perfect golf swing. For example, the right hip 304 may be thrusted forwardly ahead of the right shoulder 300 so the golfer gets their hips into the swing properly and the downstroke.

Now referring to FIG. 12A, the golf student would pass the bottom dead center location at six o'clock during the forward swing whereby the rearward pitch of the club will transition to a forward pitch. This position is similar to that as a start position except the club would be moving at a high velocity and impact a golf ball.

Figure 15A:
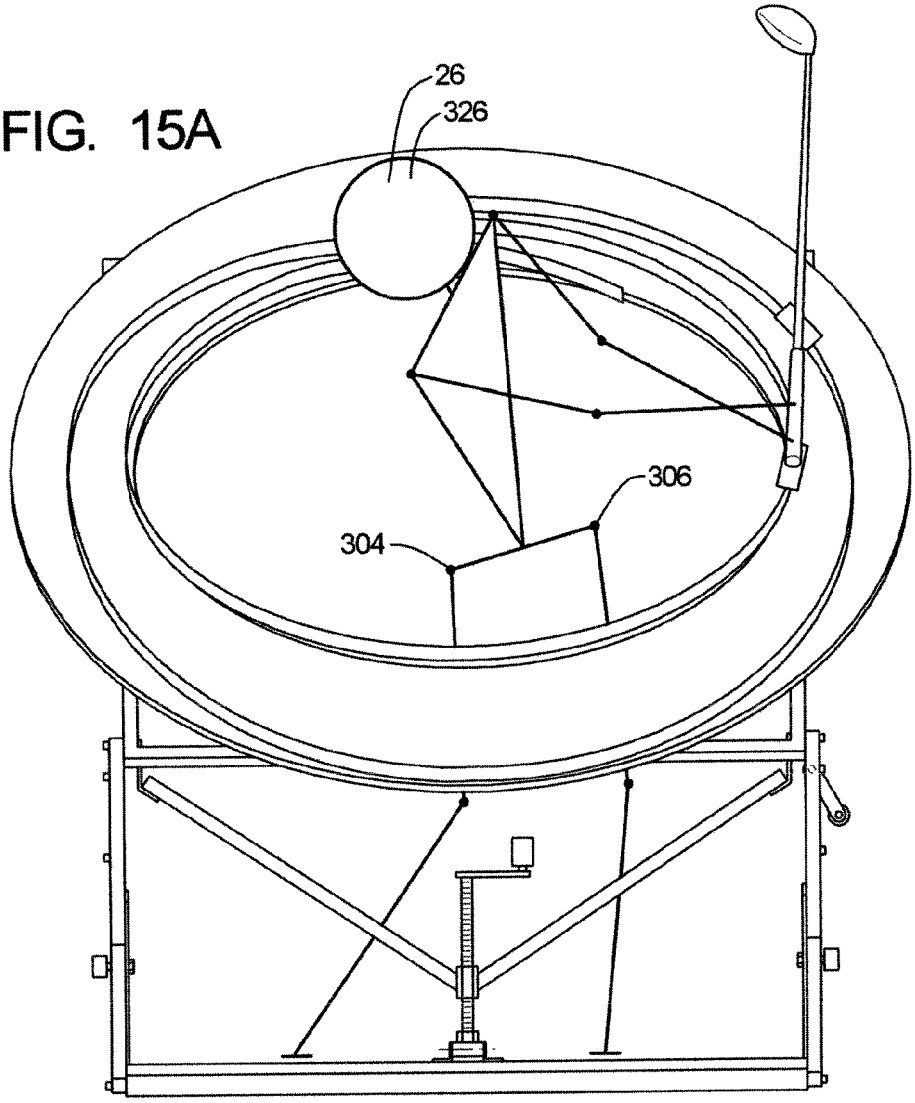
FIG. 15A is the final action drawing in the string of figures from FIG. 12A up to this figure where the golf club is shown in a proper follow-through orientation where it should be noted that because in this form the carriage assembly and golf clublike handle has one degree of freedom of movement, a golf trainer can focus on the bio-kinematic movements of the golf student with confidence the golf club has a proper swing plane, pitch and roll of the club.
Figure 15B:
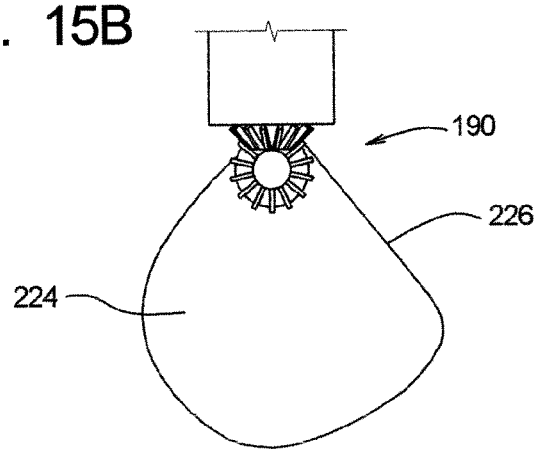
FIG. 15B is taken along line 15B-15B of FIG. 11 where the roll control system is adapted to rotate the clubhead to a closed position.

Now referring to FIG. 15A, the golf student 26 has hit the ball and is engaging in a proper follow-through whereby preferably the head 326 of the golf student has not moved appreciably in the course of the swing and the right hip 304 has properly provided a tremendous amount of force in the course of the swing. It should be noted that after the golf student 26 is familiar with breaking their wrists from a rearward pitch to forward pitch, the pivot transition system 240 as discussed in FIG. 6, can be deactivated where the engaging member 244 is orientated in a matter as shown in the hatched line indicated at 244A and FIG. 5 whereby the wheel 246 simply travels with the carriage and does not engage any stationary surfaces. If the golf student has difficulty in breaking their wrists and the club ends up to the undesirable and ergonomically unfeasible position as shown in the hatched line in FIG. 7A, the engagement member 244 can be repositioned to the operative location as indicated by the darker line in the lower right hand portion of FIG. 5.

Therefore, it can be appreciated that in the rearward pitch region the golf club face is in an open position or alternatively the golf clublike handle is positioned in a manner to represent an open face orientation of the golf club in the forward pitch region the golf clublike handle 180 is adapted to be rotated and a closed face orientation. Of course it is desirable to have an actual golf club with a golf clubhead; however, the apparatus is functional with only a golf clublike handle attached to the carriage assembly.

Now referring to FIGS. 19-23, a second embodiment of the golf swing apparatus 20 is shown whereby the roll of the club is controlled by another roll control system 350. In this embodiment, the initially described roll control system 190 is essentially deactivated whereby the club headgear 192 or the carriage gear 194 are not fixedly attached to the golf clublike handle 180 or the upper portion 150 of the first carriage 144. In other words, for the roll control system 190 to operate, the gears 192 and 194 are respectively fixedly attached to the golf clublike handle 180 and the first carriage 144. If either of these gears are no longer fixedly attached and can rotate irrespective to these adjacent attachment locations, then the golf clublike handle cannot rotate irrespective of the pitch thereof. It should be noted that the club grasping member 202 as shown in FIG. 5 has a bearing like surface that allows the golf clublike handle 180 to freely rotate therein.

It should be noted that in a similar fashion, the roll control system can be completely bypassed in a similar matter where one of the gears in the roll control system is not fixedly positioned to its adjacent structure. In fact, in the broader scope, having the roll control system not employed is a desirable option where the golf swing apparatus 20 has more than one degree of freedom of movement.

Figure 20:
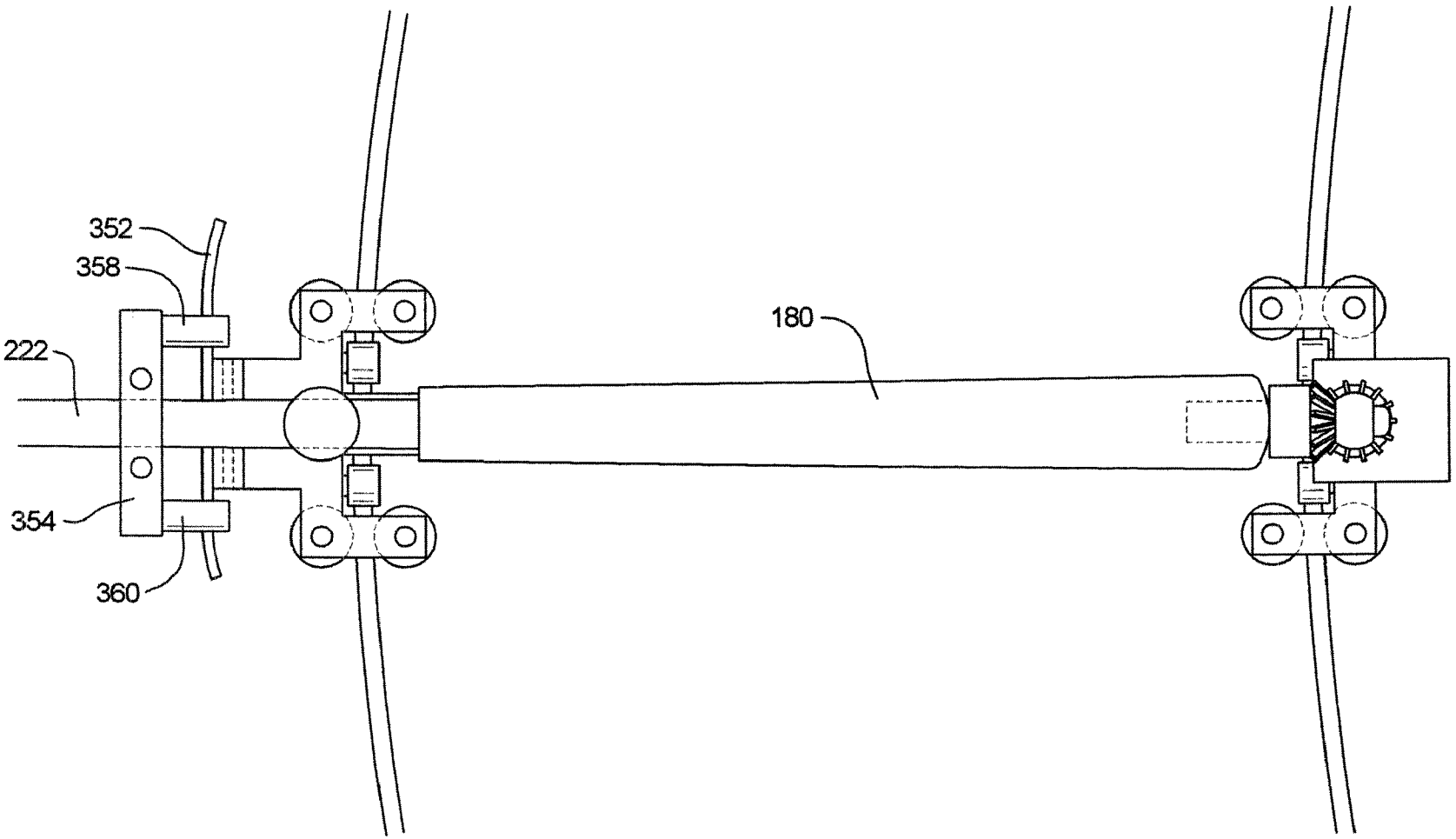
FIG. 20 is a front view of the second type of roll control system.
Figure 21:
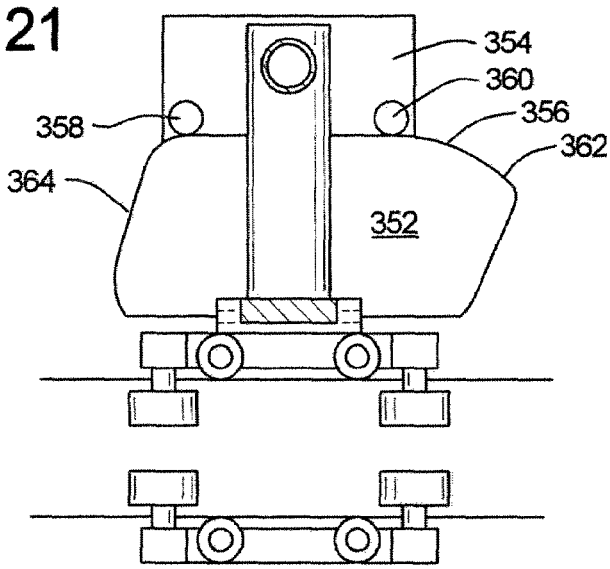
FIG. 21 is a front view of the second type of roll control system where the carriage assembly is orientated in a bottom dead center location.
Figure 22:
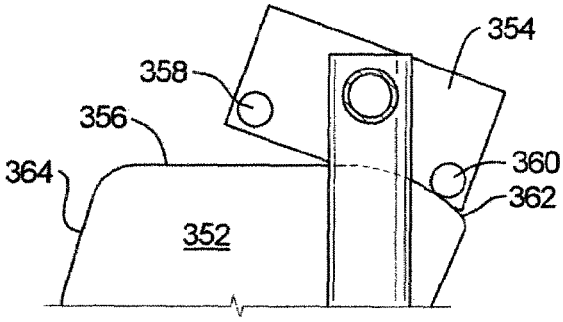
FIG. 22 is a front view of the second roll control system whereby the carriage assembly and the portion of the swing is in a rearward type pitch where the cam of the roll control system and the engagement roller is adapted to control the amount of rearward open face roll.
Figure 23:
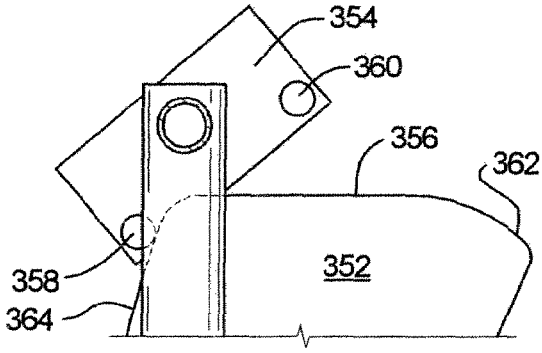
FIG. 23 shows the second roll control system in an orientation past the six o'clock bottom dead center location of the swing whereby the club face is allowed to roll a greater extent to the forward closed clubhead position to accommodate the ergonomics of the golf student.

In general, the roll control system 350 comprises a cam 352 and a cam follower 354. The cam 352 has an outer cam track surface 356 where as shown in FIG. 21, the carriage assembly 32 is approximately near the bottom dead center location. The cam follower 354 in one form has first and second cam engagement members 358 and 360. As indicated in FIG. 22, when the cam follower 354 is rearwardly positioned between the nine o'clock and six o'clock orientations in the swing, the engaging member 360 engages the forward portion 362 of the cam track surface 356. As the golfer swings forward, the orientation is such as shown in FIG. 21 and during the follow-through, the engaging member 358 engages the rearward portion 364 of the cam track surface 356 whereby allowing the club to roll forward and give a proper ergonomic break in the wrist for the follow-through. As shown in FIG. 20, the cam follower 354 is rigidly attached to the shaft portion 222 of the golf clublike handle 180. This cam follower is particularly advantageous whereby an instructor is trying to teach a style of golf where the break of the wrists in the rearward direction is minimal and the club face is maintained relatively square to the point of impact.

Figure 24:
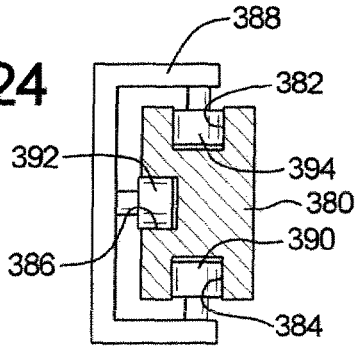
FIG. 24 shows a second embodiment of the rail system whereby less bearings are employed to operate the first and second carriages.

FIG. 24 shows a secondary rail system whereby the rail 380 is shown and provides a plurality of conduit slots 382, 384 and 386. These slots provide for openings for a bearing system for bearings 390, 392 and 394 to be mounted therein. These bearings are operatively connected to a carriage 388 that would be similar to either the first or second carriages 144 or 145 described above. In a preferred form, the thinner dimension of the rail 380 would be bent around the perimeter whereby not incurring a plastic deformation during the adjustment of the vertical and lateral diameter of the rail system as shown in FIG. 4.

It should be noted that various modifications and changes can be made to the golf swing training aid 20 without departing from the basic teachings of the apparatus. For example, various adjustment mechanisms can orientate the position of the active area 24 as shown in FIG. 1. Further, although it is desirable to have an adjustment system for the first and second rails 34 and 36 such as that is shown in FIG. 4, a static system could be supplied for accommodating a large majority of golf students. Of course various methods of adjusting the diameter of the first and second tracks 34 and 36 can be employed such as screw type lengtheners and contractors or if the system is substantially rigid, a single adjustment mechanism can be used, whereby for example, the twelve o'clock position can increase or decrease the oval like horizontal and vertical diameter of the rail system.

It should further be noted that the carriage gears 194 and 192 do not have to be symmetric and for example the clubhead gear 192 could have additional teeth than that of the carriage gear 194 whereby the amount of roll is less with respect to the amount of pitch. Alternately, if a greater roll is desired about the club longitudinal axis 186 as shown in FIG. 5, the clubhead gear 192 would be of a smaller diameter and hence have less teeth than the carriage gear 194. Of course other methods such as a cam like device can be employed where, for example something similar to the clubhead gear 192 and carriage gear 194, would simply frictionally engage one another and potentially having non-uniform diameter at various rotation locations whereby a spring-loaded item would bias one of the gears so they are in engagement.

Figure 34:
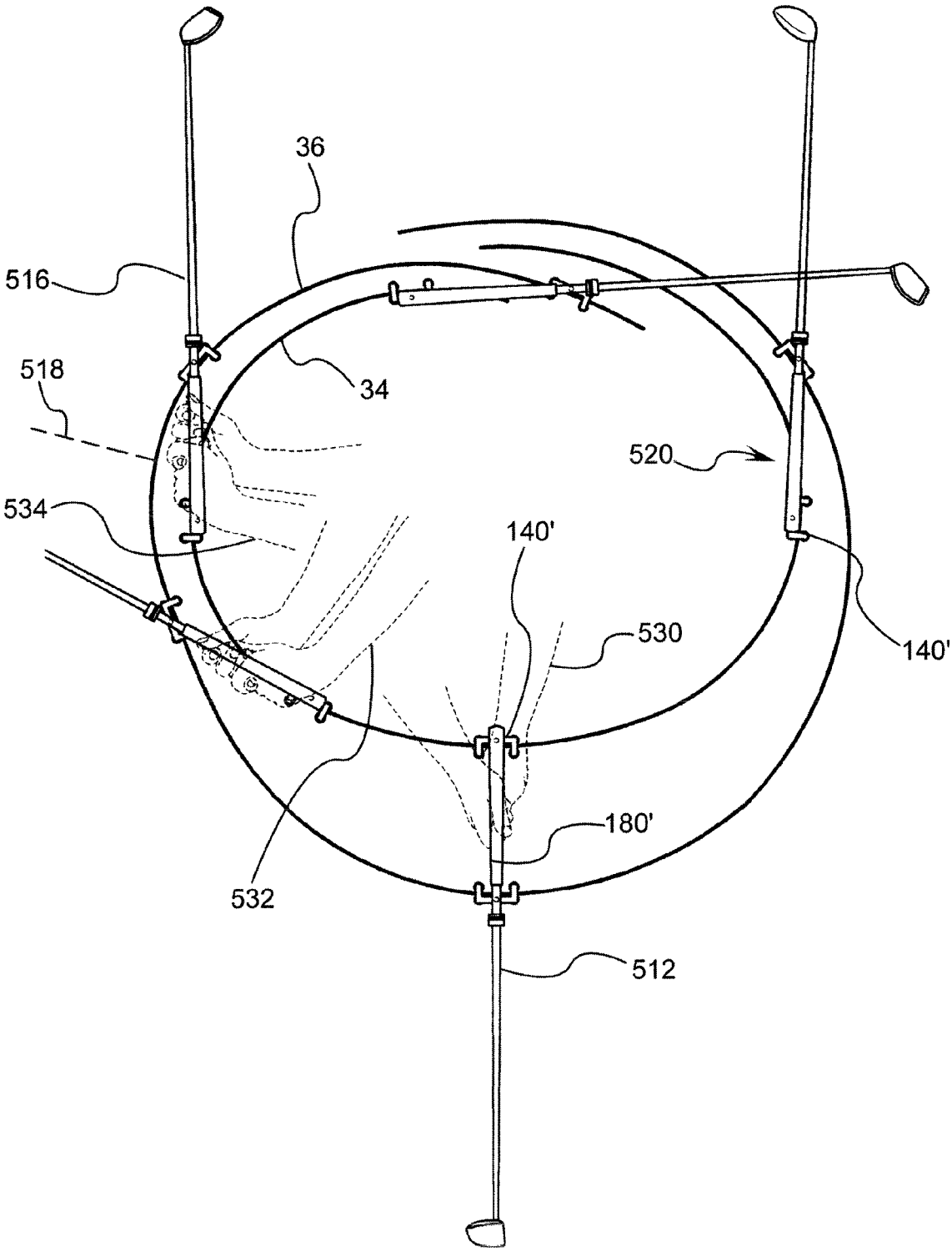
FIG. 34 shows the progression of the club head rotation where in general, the orientation shown in the lower portion is a more neutral roll which indicates the general position as illustrated in FIGS. 25-27, the rearward pitch orientation is orientated in a manner in general shown in FIGS. 28-30, and finally the forward roll orientation is the orientation of the club as shown in FIGS. 31-33.

FIG. 34 shows another variation of a roll control system. In this form, the golf club like candle 180' is operatively attached to the roll control system indicated at 490. In this form, the golf club like candle 180' is left substantially unobstructed in the first handle region 182'.

Figure 25:
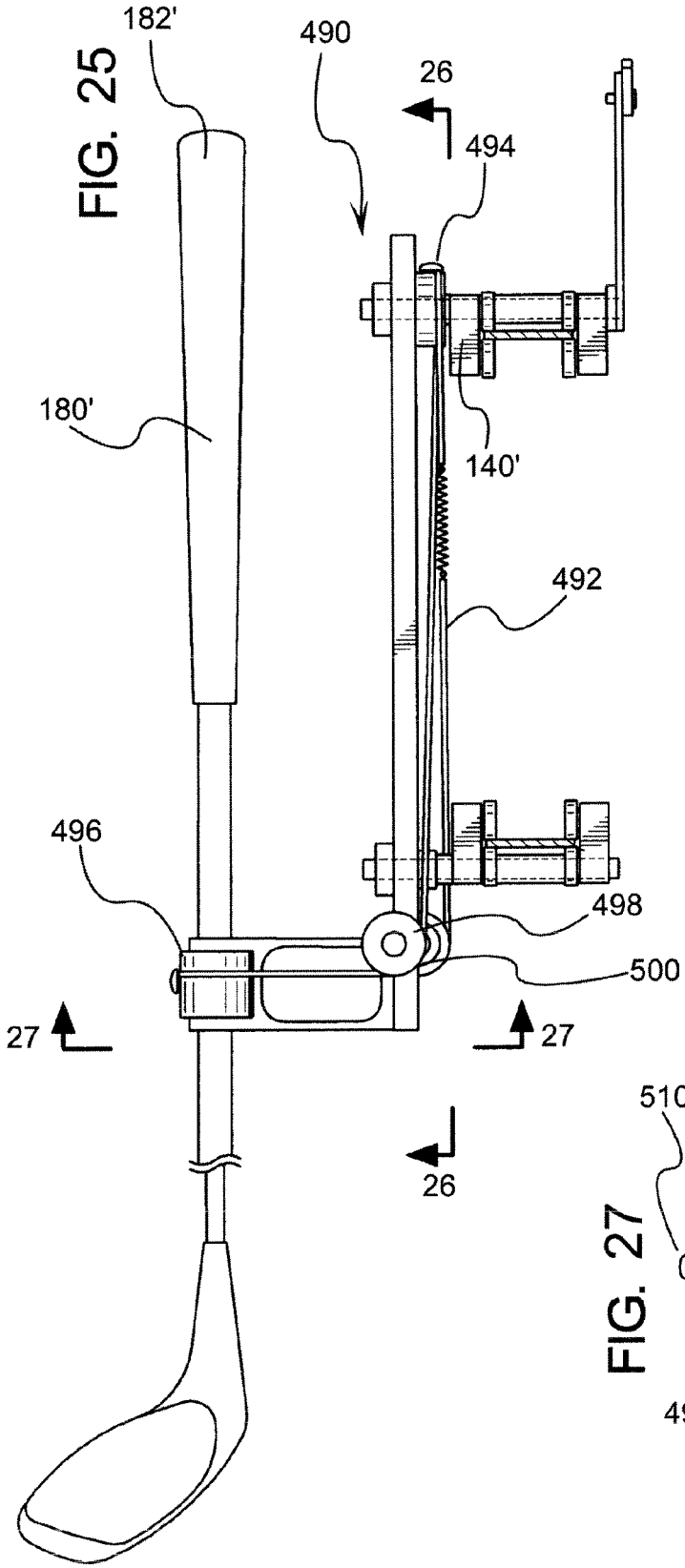
FIG. 25 shows a side view of another embodiment of a carriage assembly.
Figure 26:
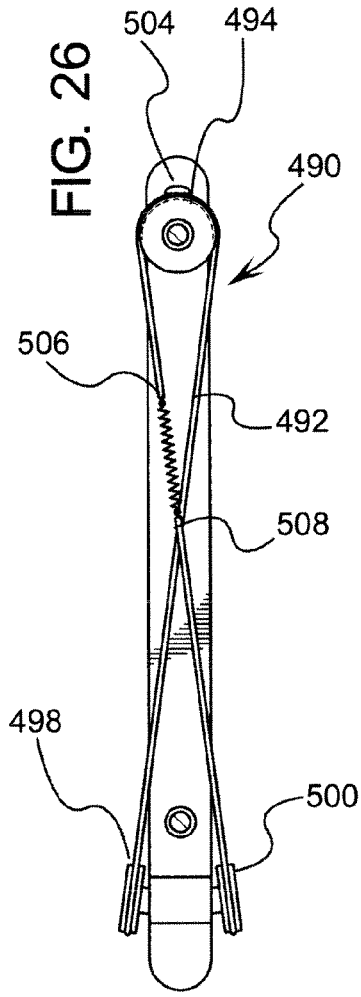
FIG. 26 shows a rear view of the carriage assembly showing a cable-like mechanism which helps translate the rotation of the club with respect to the rotation of the carriage assembly about a transverse axis.
Figure 27:
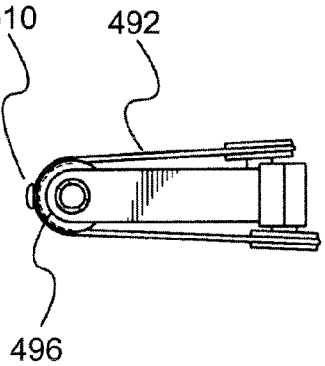
FIG. 27 is taken along line 27-27 of FIG. 25.
Figure 28:
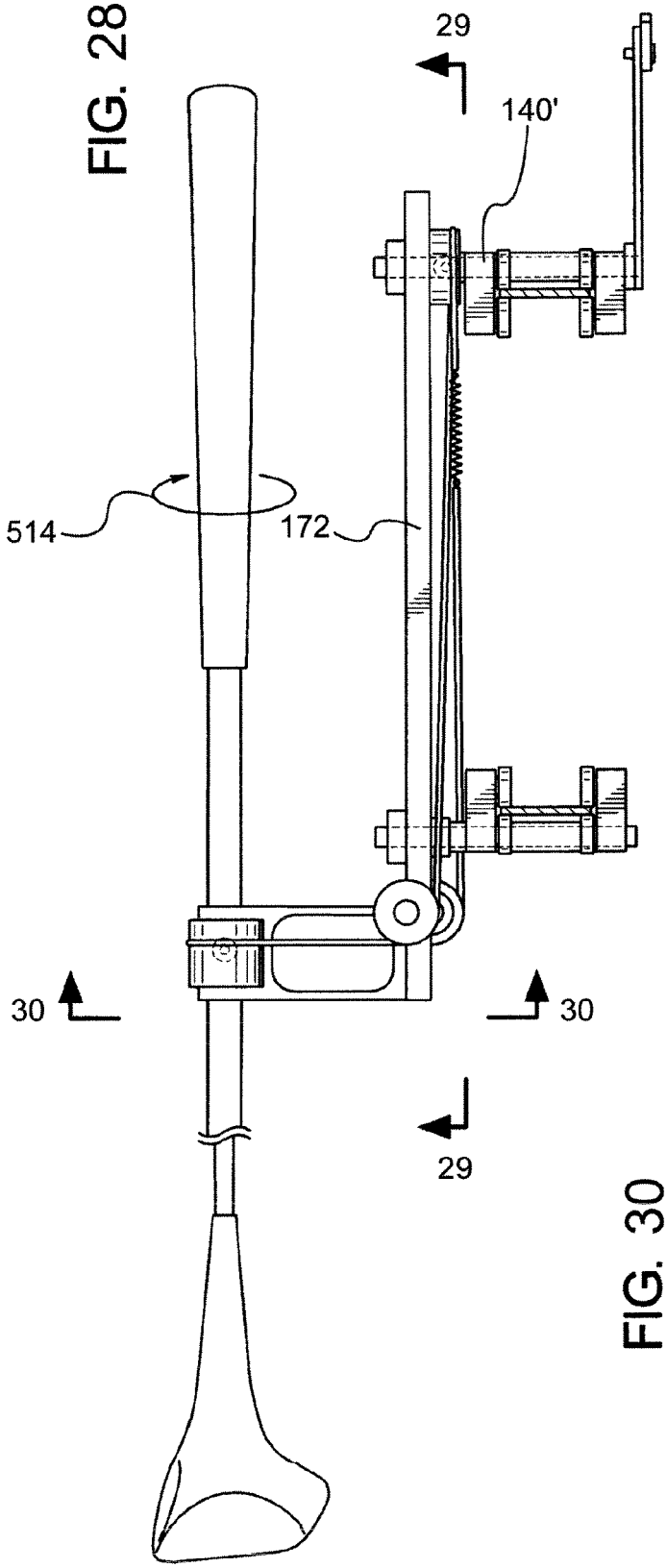
FIG. 28 shows the club rotating with respect to the rotation of the carriage assembly about a transverse axis.
Figure 29:
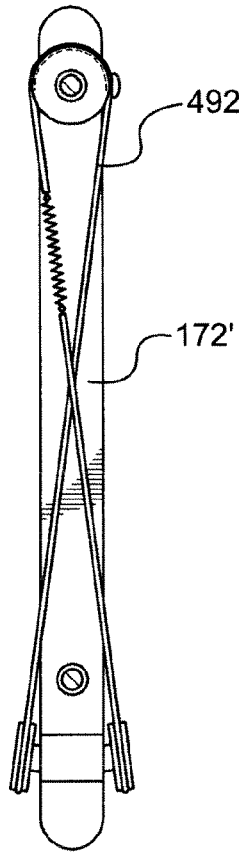
FIG. 29 shows a carriage assembly rotated a certain amount to rotate the club in a rearward rolling action.
Figure 30:
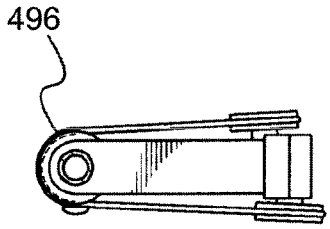
FIG. 30 is taken along line 30-30 of FIG. 28 showing the rotation of the club head.

The roll control system 490 in general comprises a control cord 492 a base attachment region 494 and a club attachment 496. Further, the roll control system 490 comprises various transition police 498 and 500 that redirect the control cable 492 to transmit the rotational torque-like energy from the base attachment region 494 to the club attachment region 496. As shown in FIG. 26 taken at line 26-26 of FIG. 25, there is a rearward view of the roll control system 490. The control cable 492 is fixedly attached to the base attachment region 494 wherein in form a bolt 504 or other form of attachment mechanism fixedly and adjustably mounts the cable to the base attachment region 494. The base attachment region is in turn attached to the first attachment region 140' of the carriage assembly. A take-up mechanism 506 such as attention spring can be applied somewhere along the close looped circuit of the control cable 492 to supply a sufficient amount of tension thereto and further provide some bufference to the system. As shown in FIG. 26, the roll control cable 492 crosses at the intersect region 508 to properly transmit the correct rotational direction of the club like candle 180'. FIG. 27 shows a bottom view looking up at the unit where at the club attachment region 496 the control cable 492 is also rigidly attached thereto by an attachment like mechanism 510 which also can be a bolt to adjustably and fixedly fix the control cable 492 to a specific rotational position of the golf club like handle 180'. FIGS. 25-27 in general show the, as shown in FIG. 34, the orientation of the club is at the approximate six o'clock position indicated at 512 in FIG. 34. Of course, the members 504 and 510 shown in FIGS. 26 and 27 can be initially adjusted to properly orientate the golf club like handle 180' to a proper orientation. Now referring to FIGS. 28-30, it can be seen how the roll of the golf club is done in a rearward like direction indicated at 514. Where referring ahead to FIG. 34, the orientation is approximately that as shown at 516 were the golf club is pitched rearwardly with respect to a radially extending line 518. This rearward pitch basically rotates the support bar 172' with respect to the first attachment region 140' of the carriage assembly. Whereby slack is taken up in the first portion 490 which translates into a rotation of the club attachment region 496 which opens the club face out indicated in the lower left-hand portion of FIG. 28.

Figure 31:
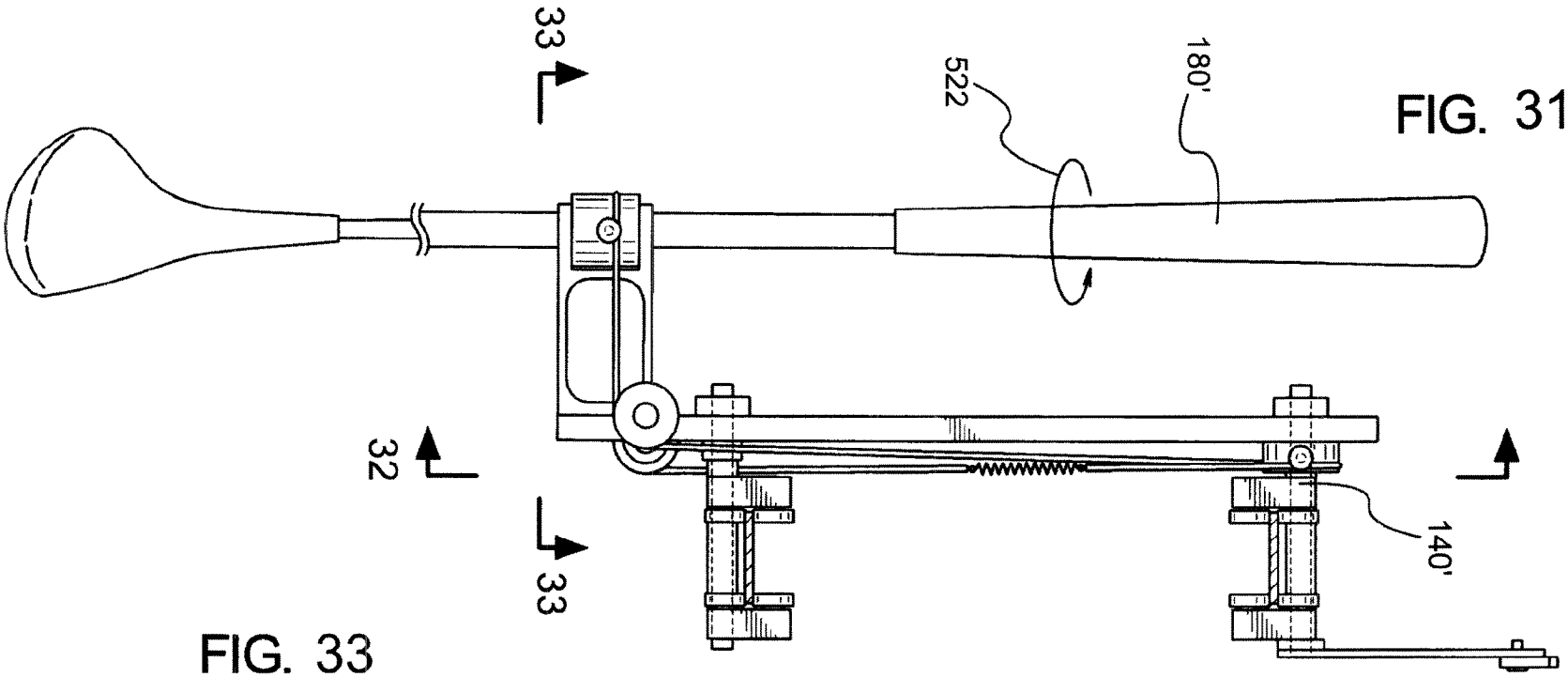
FIG. 31 shows a rotation of the clubhead in a forward rolled orientation.
Figure 32:
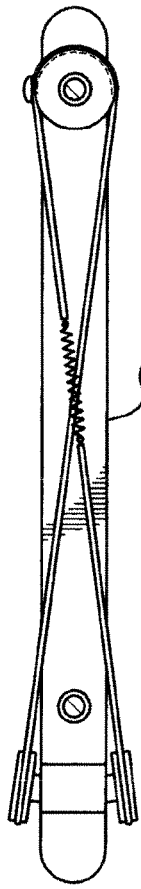
FIG. 32 is taken along line 32-32 of FIG. 31 showing the rotation of the club in a more forward rolled orientation.
Figure 33:
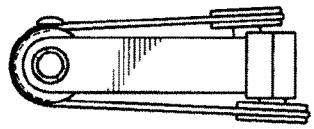
FIG. 33 is taken along line 33-33 of FIG. 31 showing the rotation of the club head in a more forward rotated orientation.

Now referring to FIGS. 31-33, it can be appreciated how the golf club like handle 180' is in a closed roll position as indicated by the position approximately at 520 in FIG. 34. In this orientation the position of the support bar 172' is such with respect to the first attachment portion 140' of the carriage assembly that the relative rotation translate into a rotating motion indicated by the rotational vector 522 wherein this form the golf clubhead has rolled into a closed face orientation.

FIG. 34 shows various progressive views where it can be appreciated that the first and second tracks 36 and 34 and 36 by having a different spacing about a radio reference line such as that as shown at 518 accommodates various pitch and roll angles of the golf club like handle. The various hand positions indicated at 530, 532 and 534 in FIG. 34 illustrate how the unit trains a golf student to properly break their wrist in a rearward stroke as well as roll out the club face to an open orientation about the axis of the golf club shaft.

Of course various modifications and alternative forms of the golf swing apparatus can be employed where specific embodiments thereof have been shown by way of example in the drawings and described above in detail. It should be understood, however, that such an enabling description is not intended to limit the invention to the particular form disclosed, but rather, on the contrary the intention of such disclosure and claims set forth below is to cover all modifications, equivalence and alternatives falling within the spirit and scope of the claims.

Therefore I claim:

1. A golf swing apparatus adapted to train a golf student with a golf swing having rearward and forward swing directions and having various swing positions, the golf swing apparatus comprising:

a) a frame arranged to support a first rail and a second rail, b) the first and second rails defining a swing plane, c) a carriage having a first attachment region and a second attachment region where the first attachment region is arranged to be movably attached to the first rail and the second attachment region is arranged to be movably attached to the second rail, the first and second attachment regions being positioned at a substantially fixed distance from one another on the carriage, d) the carriage further having a golf club like handle having a connection portion attached to the carriage, e) the carriage being arranged to reposition in a rearward swing direction and a forward swing direction whereby the distance between the first rail and the second rail in the swing plane fluctuates with respect to the location of the carriage at various swing positions whereby said distance between the first and second rail at various swing positions dictates the pitch of the carriage and handle substantially about a forward-rearward axis providing the golf student with a desired golf swing.

2. The golf swing apparatus as recited in claim 1 whereby a roll control system is operatively attached to the golf club like handle whereby the golf clublike handle is adapted to roll about a club longitudinal axis with respect to the pitch.

3. The golf swing apparatus as recited in claim 2 whereby the roll control system comprises a roll control cable fixedly attached to the golf club like handle and the carriage whereby torque is transferred to the golf club like handle when the golf club like handle pitches rearwardly as the distance between the first rail and the second rail in the swing plane fluctuates with respect to the location of the carriage at various swing positions.

4. The golf swing apparatus as recited in claim 2 whereby a pivot transition system is employed that is positioned at the approximate six o'clock location of the first and second rail whereby the pivot transition system is adapted to transform the swing from a rearward pitch to a forward pitch at the approximate six o'clock location of the swing.

5. The golf swing apparatus as recited in claim 1 whereby the first and second rails are adapted to reposition to decrease the diameter of the first and second rails.

6. The golf swing apparatus as recited in claim 5 whereby the first and second rails are attached to a base adjustment disk and the base adjustment disk provides for a plurality of adjustment slots having connectors fastened therein and attached to the first and second rails.

7. The golf swing apparatus as recited in claim 6 whereby said adjustment slots are positioned at approximate three o'clock, nine o'clock and twelve o'clock locations on the base adjustment disk.

8. The golf swing apparatus as recited in claim 1 whereby a support bar is provided and pivotally attached to the first carriage and the second carriage whereby the pivot attachment of the support bar coincides with the location of the pivot attachment of the golf clublike handle at the first carriage and the second carriage.

9. The golf swing apparatus as recited in claim 1 whereby a pivot transition system is employed that is positioned at the approximate six o'clock location of the first and second rail whereby the pivot transition system is adapted to transform the swing from a rearward pitch to a forward pitch at the approximate six o'clock location of the swing.

10. The golf swing apparatus as recited in claim 9 whereby the pivot transition system comprises a pivot member that is connected to the first carriage and a pivot detent that is connected to a substantially stationary portion of the golf swing training aid whereby the pivot member is adapted to engage the pivot detent and allow the golf clublike handle to rotate to a forward pitch orientation.

11. A golfing swing training aid defining a swing plane, the golfing swing training aid comprising, a) a golf clublike handle attached at a lower portion of a golf club;

b) the golf club like handle providing an unobstructed upper region c) the golf clublike handle positioned to move in the swing plane whereby the golf club like handle is adapted to be repositioned in various orientations along a golf swing d) a pivot transition system operatively configured to pitch the golf club like handle rearwardly with respect to a radial reference line in the rearward portion of the golf swing and e) the pivot transition system is operatively configured to pitch the golf club like handle forwardly with respect to a radial reference line in the forward portion of the golf swing.

12. The golfing swing training aid as recited in claim 11 further comprising a roll control system operatively configured to continuously adjust the roll of the golf club like handle with respect to the position of the golf clublike handle at various positions along the golf swing.

13. The golfing swing training aid as recited in claim 11 wherein the pivot transition system operatively configured to assist the golf clublike handle transition from a rearward pitch in the rearward portion of the proper golf swing to a forward pitch in the forward portion of the proper golf swing.

14. The golfing swing training aid as recited in claim 11 further comprising a rail system defining the golf swing wherein the rail system is adjustable in the width dimension and height dimension.

15. The golf swing apparatus as recited in claim 11 wherein the pivot transition system is adapted to transform the swing from a rearward pitch to a forward pitch with respect to a radially extending reference line at the approximate six o'clock location of the proper golf swing.

16. A golf swing training aid comprising a) a confined motion within a defined swing plane b) where the golf swing training aid has a rearward pitch region and a forward pitch region c) where the golf swing training aid is operatively configured to position a golf clublike handle having a club longitudinal axis in the rearward pitch orientation in the rearward pitch region and position the golf clublike handle in a forward pitch orientation in the forward pitch region and the golf clublike handle is mandated to have an open face orientation in the rearward pitch region and a closed face orientation in the forward pitch region d) where the golf clublike handle travels in a swing plane in the rearward pitch region and the forward pitch region e) where the open face and closed face orientations are defined by a rotation of the golf clublike handle about the club longitudinal axis whereby the roll of the golf clublike handle is controlled by a roll control system that comprises a roll control cable fixedly attached to the golf club like handle and a f) carriage is provided where torque is transferred to the golf club like handle when the golf club like handle pitches rearwardly as the distance between a first rail and a second rail in the swing plane fluctuates with respect to the location of the carriage at various swing positions.

17. The golf swing apparatus as recited in claim 16 further comprising a) a pivot transition system is employed that is positioned at the approximate six o'clock location of the first and second rail b) whereby the pivot transition system is adapted to transform the swing from a rearward pitch to a forward pitch at vertically lower location of the swing.

18. The golf swing apparatus as recited in claim 17 whereby the pivot transition system comprises a) a pivot member that is connected to a carriage and b) a pivot detent that is connected to a substantially stationary portion of the golf swing training aid c) whereby the pivot member is adapted to engage the pivot detent and allow the golf clublike handle to rotate to a forward pitch orientation.

19. The golf swing training aid as recited in claim 16 further comprising a) a carriage;

b) where the golf clublike handle is attached to the carriage which is movably attached to a rail system having first and second rails that are positioned radially inwardly and radially outwardly with respect to one another and c) the relative distance between the first and second rail is changed at various portions of the swing plane to control the pitch of the golf clublike handle.

20. The golf swing training aid as recited in claim 19 where the golf clublike handle comprises a shaft and a golf club head.

21. The golf swing training aid as recited in claim 20 where the golf swing training aid comprises a platform to place a golf ball thereon and is adapted to hit a golf ball when transitioning from the rearward pitch region to the forward pitch region.

* * * * *